US010989037B2

(12) United States Patent
Papouras et al.

(10) Patent No.: US 10,989,037 B2
(45) Date of Patent: Apr. 27, 2021

(54) APPARATUS, SYSTEMS, AND METHODS FOR SLIDE DRILLING OPTIMIZATION BASED ON STAND-BY-STAND PERFORMANCE MEASUREMENTS

(71) Applicant: NABORS DRILLING TECHNOLOGIES USA, INC., Houston, TX (US)

(72) Inventors: Christopher Papouras, Houston, TX (US); Austin Groover, Spring, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 338 days.

(21) Appl. No.: 15/982,457

(22) Filed: May 17, 2018

(65) Prior Publication Data

US 2019/0353024 A1 Nov. 21, 2019

(51) Int. Cl.

| | |
|---|---|
| ***E21B 44/02*** | (2006.01) |
| ***E21B 47/008*** | (2012.01) |
| ***E21B 41/00*** | (2006.01) |
| ***E21B 7/04*** | (2006.01) |
| ***E21B 15/04*** | (2006.01) |

(52) U.S. Cl.

CPC ..... *E21B 44/02* (2013.01); *E21B 7/04* (2013.01); *E21B 41/0092* (2013.01); *E21B 47/008* (2020.05); *E21B 15/04* (2013.01)

(58) Field of Classification Search

CPC ..... E21B 44/02; E21B 47/008; E21B 7/04; E21B 41/0092; E21B 15/04

See application file for complete search history.

(56) References Cited

U.S. PATENT DOCUMENTS

| | | | | |
|---|---|---|---|---|
| 2008/0156531 | A1* | 7/2008 | Boone | E21B 44/00 175/27 |
| 2013/0161097 | A1* | 6/2013 | Benson | E21B 47/12 175/26 |
| 2013/0231787 | A1* | 9/2013 | Chapman | E21B 44/00 700/282 |
| 2016/0145993 | A1* | 5/2016 | Gillan | E21B 7/067 175/24 |

* cited by examiner

*Primary Examiner* — Manuel L Barbee

(74) *Attorney, Agent, or Firm* — Haynes and Boone, LLP

(57) ABSTRACT

A method, apparatus, and system according to which a drilling engine includes a template having a plurality of data fields outlining operational steps and parameters to perform a drilling process, the data fields having a plurality of recipe settings input therein to facilitate performance of the drilling process. A computer system communicates with the drilling engine and an operational equipment engine, and is configured to send a first control signal, based on the template and the recipe settings, to the operational equipment engine to cause the operational equipment engine to perform the drilling process to drill a first wellbore segment. A sensor engine is configured to monitor a key performance indicator ("KPI") of the operational equipment engine during the performance of the drilling process. In some embodiments, the drilling engine includes a recipe optimization module configured to modify, based on the monitored KPI, at least one of the recipe settings.

19 Claims, 13 Drawing Sheets

APPARATUS, SYSTEMS, AND METHODS FOR SLIDE DRILLING OPTIMIZATION BASED ON STAND-BY-STAND PERFORMANCE MEASUREMENTS

TECHNICAL FIELD

The present disclosure relates generally to oil and gas drilling and production operations, and, more particularly, to an apparatus, system and method according to which slide drilling is optimized based on stand-by-stand performance measurements.

BACKGROUND

At the outset of a drilling operation, drillers typically establish a drill plan that includes a steering objective location (or target location) and a drilling path to the steering objective location. Once drilling commences, the bottom-hole assembly (BHA) may be directed or "steered" from a vertical drilling path in any number of directions, to follow the proposed drill plan. For example, to recover an underground hydrocarbon deposit, a drill plan might include a vertical bore to the side of a reservoir containing a deposit, then a directional or horizontal bore that penetrates the deposit. The operator may then follow the plan by steering the BHA through the vertical and horizontal aspects in accordance with the well plan.

In slide drilling implementations, such directional drilling requires accurate orientation of a bent housing of the down hole motor. The bent housing has a predetermined angle of bend. The high side of this bend is referred to as the toolface of the BHA. In such slide drilling implementations, rotating the drill string changes the orientation of the bent housing and the BHA, and thus the toolface. To effectively steer the assembly, the operator must first determine the current toolface orientation. Thereafter, if the drilling direction needs adjustment, the operator must rotate the drill string or alter other surface drilling parameters to change the toolface orientation.

Well operators rely upon experience and conventional best practices to create processes for carrying out tasks, such as slide drilling, in an efficient and effective manner. However, more efficient, reliable, and intuitive methods for identifying efficient and effective rig processes are needed.

DETAILED DESCRIPTION

Figure 1:
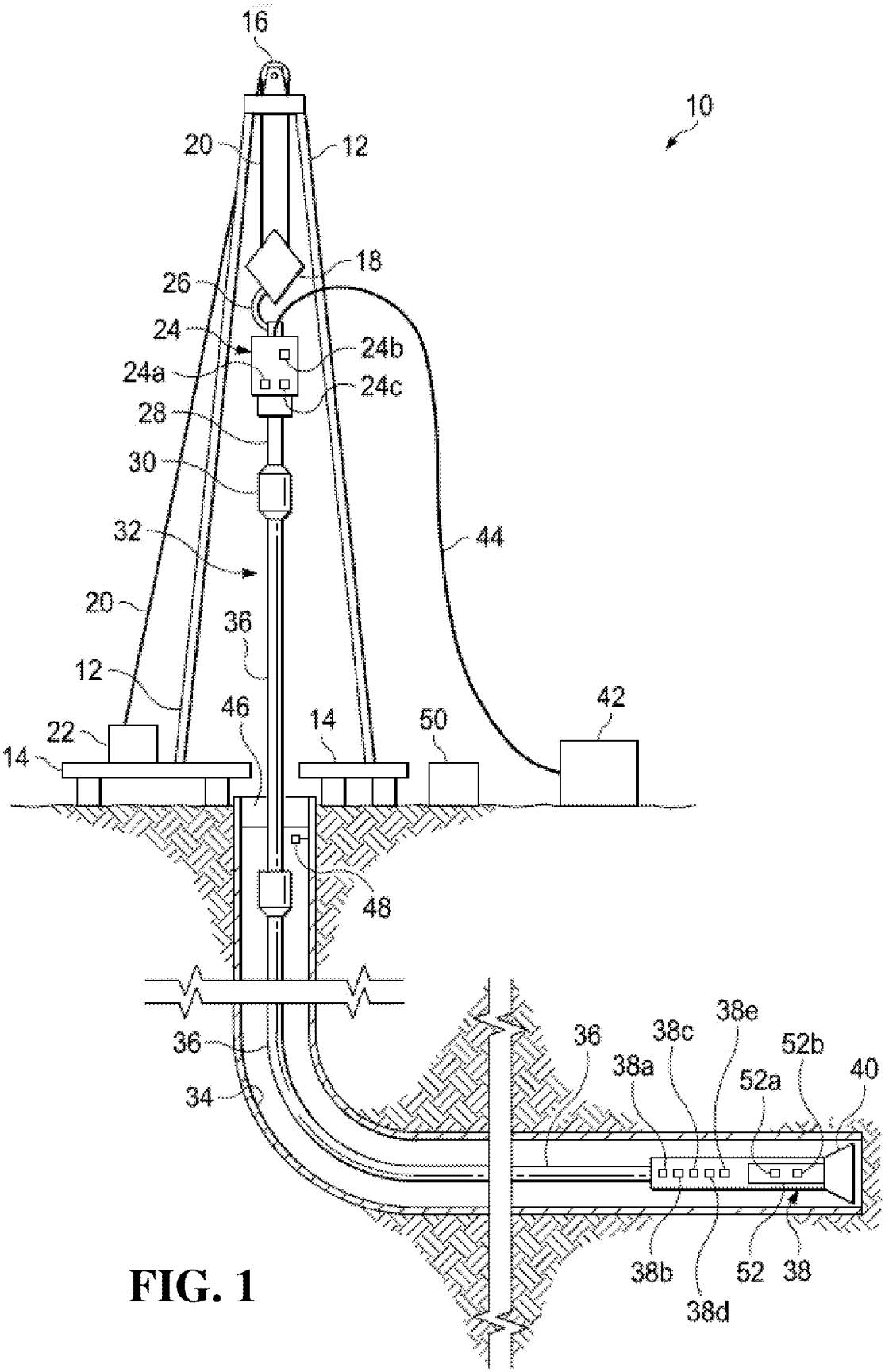
FIG. 1 is an elevational/schematic view of a drilling rig, according to one or more embodiments of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed to a systematic approach for modifying existing operational templates and/or recipe settings to optimize a slide drilling process on a drilling rig. The slide drilling process may be executed based on best practices documented in well programs and/or through trial and error. In some embodiments, historical time-series data may be utilized to identify the various setpoints and processes needed to execute the slide drilling process—this data may then be used to develop operational templates and/or recipe settings to enable the drilling rig's performance of the slide drilling process. Additionally, the drilling rig may be configured to monitor key performance indicators ("KPIs") including, for example, pre-slide time, toolface setting time, burned time, burned footage, slide score, and slide rate of penetration ("ROP"). These KPIs can then be used to define success criteria for each task in the process of slide drilling a stand down, and to modify the operational templates and/or recipe settings to optimize the drilling rig's performance of the slide drilling process.

Referring to FIG. 1, an embodiment of such a drilling rig (a.k.a., drilling equipment) for implementing the aims of the present disclosure is schematically illustrated and generally referred to by the reference numeral 10. The drilling rig 10 is or includes a land-based drilling rig—however, one or more aspects of the present disclosure are applicable or readily adaptable to any type of drilling rig (e.g., a jack-up rig, a semisubmersible, a drill ship, a coiled tubing rig, a well service rig adapted for drilling and/or re-entry operations, and a casing drilling rig, among others). The drilling rig 10 includes a mast 12 that supports lifting gear above a rig floor 14, which lifting gear includes a crown block 16 and a traveling block 18. The crown block 16 is coupled to the mast 12 at or near the top of the mast 12. The traveling block 18 hangs from the crown block 16 by a drilling line 20. The drilling line 20 extends at one end from the lifting gear to drawworks 22, which drawworks 22 are configured to reel out and reel in the drilling line 20 to cause the traveling block 18 to be lowered and raised relative to the rig floor 14. The other end of the drilling line 20 (known as a dead line anchor) is anchored to a fixed position, possibly near the drawworks 22 (or elsewhere on the rig).

The drilling rig 10 further includes a top drive 24, a hook 26, a quill 28, a saver sub 30, and a drill string 32. The top drive 24 is suspended from the hook 26, which hook is attached to the bottom of the traveling block 18. The quill 28 extends from the top drive 24 and is attached to a saver sub 30, which saver sub is attached to the drill string 32. The drill string 32 is thus suspended within a wellbore 34. The quill 28 may instead be attached directly to the drill string 32. The term "quill" as used herein is not limited to a component which directly extends from the top drive 24, or which is otherwise conventionally referred to as a quill 28. For example, within the scope of the present disclosure, the "quill" may additionally (or alternatively) include a main shaft, a drive shaft, an output shaft, and/or another component which transfers torque, position, and/or rotation from the top drive 24 or other rotary driving element to the drill string 32, at least indirectly. Nonetheless, albeit merely for the sake of clarity and conciseness, these components may be collectively referred to herein as the "quill."

The drill string 32 includes interconnected sections of drill pipe 36, a bottom-hole assembly ("BHA") 38, and a drill bit 40. The BHA 38 may include stabilizers, drill collars, and/or measurement-while-drilling ("MWD") or wireline conveyed instruments, among other components. The drill bit 40 is connected to the bottom of the BHA 38 or is otherwise attached to the drill string 32. One or more mud pumps 42 deliver drilling fluid to the drill string 32 through a hose or other conduit 44, which conduit may be connected to the top drive 24. The downhole MWD or wireline conveyed instruments may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted in real-time or delayed time to the surface. Data transmission methods may include, for example, digitally encoding data and transmitting the encoded data to the surface as pressure pulses in the drilling fluid or mud system. The MWD tools and/or other portions of the BHA 38 may have the ability to store measurements for later retrieval via wireline and/or when the BHA 38 is tripped out of the wellbore 34.

The drilling rig 10 may also include a rotating blow-out preventer ("BOP") 46, such as if the wellbore 34 is being drilled utilizing under-balanced or managed-pressure drilling methods. In such an embodiment, the annulus mud and cuttings may be pressurized at the surface, with the actual desired flow and pressure possibly being controlled by a choke system, and the fluid and pressure being retained at the well head and directed down the flow line to the choke system by the rotating BOP 46. The drilling rig 10 may also include a surface casing annular pressure sensor 48 configured to detect the pressure in the annulus defined between, for example, the wellbore 34 (or casing therein) and the drill string 32. In the embodiment of FIG. 1, the top drive 24 is utilized to impart rotary motion to the drill string 32. However, aspects of the present disclosure are also applicable or readily adaptable to embodiments utilizing other drive systems, such as a power swivel, a rotary table, a coiled tubing unit, a downhole motor, and/or a conventional rotary rig, among others.

The drilling rig 10 also includes a control system 50 configured to control or assist in the control of one or more components of the drilling rig 10—for example, the control system 50 may be configured to transmit operational control signals to the drawworks 22, the top drive 24, the BHA 38 and/or the mud pump(s) 42. The control system 50 may be a stand-alone component installed near the mast 12 and/or other components of the drilling rig 10. In some embodiments, the control system 50 includes one or more systems located in a control room proximate the drilling rig 10, such as the general purpose shelter often referred to as the "doghouse" serving as a combination tool shed, office, communications center, and general meeting place. The control system 50 may be configured to transmit the operational control signals to the drawworks 22, the top drive 24, the BHA 38, and/or the mud pump(s) 42 via wired or wireless transmission (not shown). The control system 50 may also be configured to receive electronic signals via wired or wireless transmission (also not shown) from a variety of sensors included in the drilling rig 10, where each sensor is configured to detect an operational characteristic or parameter. The sensors from which the control system 50 is configured to receive electronic signals via wired or wireless transmission (not shown) may include one or more of the following: a torque sensor 24*a*, a speed sensor 24*b*, a WOB sensor 24*c*, a downhole annular pressure sensor 38*a*, a shock/vibration sensor 38*b*, a toolface sensor 38*c*, a WOB sensor 38*d*, the surface casing annular pressure sensor 48, a mud motor delta pressure ("ΔP") sensor 52*a*, and one or more torque sensors 52*b*.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data. The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the drilling rig 10.

The drilling rig 10 may include any combination of the following: the torque sensor 24*a*, the speed sensor 24*b*, and the WOB sensor 24*c*. The torque sensor 24*a* is coupled to or otherwise associated with the top drive 24—however, the torque sensor 24*a* may alternatively be located in or associated with the BHA 38. The torque sensor 24*a* is configured to detect a value (or range) of the torsion of the quill 28 and/or the drill string 32 in response to, for example, operational forces acting on the drill string 32. The speed sensor 24*b* is configured to detect a value (or range) of the rotational speed of the quill 28. The WOB sensor 24*c* is coupled to or otherwise associated with the top drive 24, the drawworks 22, the crown block 16, the traveling block 18, the drilling line 20 (which includes the dead line anchor), or another component in the load path mechanisms of the drilling rig 10. More particularly, the WOB sensor 24*c* includes one or more sensors different from the WOB sensor 38*d* that detect and calculate weight-on-bit, which can vary from rig to rig (e.g., calculated from a hook load sensor based on active and static hook load).

Further, the drilling rig 10 may additionally (or alternatively) include any combination of the following: the downhole annular pressure sensor 38*a*, the shock/vibration sensor 38*b*, the toolface sensor 38*c*, and the WOB sensor 38*d*. The downhole annular pressure sensor 38*a* is coupled to or otherwise associated with the BHA 38, and may be configured to detect a pressure value or range in the annulus-shaped region defined between the external surface of the BHA 38 and the internal diameter of the wellbore 34 (also referred to as the casing pressure, downhole casing pressure, MWD casing pressure, or downhole annular pressure). Such measurements may include both static annular pressure (i.e., when the mud pump(s) 42 are off) and active annular pressure (i.e., when the mud pump(s) 42 are on). The shock/vibration sensor 38*b* is configured for detecting shock and/or vibration in the BHA 38. The toolface sensor 38*c* is configured to detect the current toolface orientation of the drill bit 40, and may be or include a magnetic toolface sensor which detects toolface orientation relative to magnetic north or true north. In addition, or instead, the toolface sensor 38*c* may be or include a gravity toolface sensor which detects toolface orientation relative to the Earth's gravitational field. In addition, or instead, the toolface sensor 38*c* may be or include a gyro sensor. The WOB sensor 38*d* may be integral to the BHA 38 and is configured to detect WOB at or near the BHA 38.

Further still, the drilling rig 10 may additionally (or alternatively) include a MWD survey tool 38*e* at or near the BHA 38. In some embodiments, the MWD survey tool 38*e* includes any of the sensors 38*a*-38*d* as well as combinations of these sensors. The BHA 38 and the MWD portion of the BHA 38 (which portion includes the sensors 38*a-d* and the MWD survey tool 38*e*) may be collectively referred to as a "downhole tool." Alternatively, the BHA 38 and the MWD portion of the BHA 38 may each be individually referred to as a "downhole tool." The MWD survey tool 38*e* may be configured to perform surveys along length of a wellbore, such as during drilling and tripping operations. The data from these surveys may be transmitted by the MWD survey tool 38*e* to the control system 50 through various telemetry methods, such as mud pulses. In addition, or instead, the data from the surveys may be stored within the MWD survey tool 38*e* or an associated memory. In this case, the survey data may be downloaded to the control system 50 when the MWD survey tool 38*e* is removed from the wellbore or at a maintenance facility at a later time. The MWD survey tool 38*e* is discussed further below with reference to FIG. 2.

Finally, the drilling rig 10 may additionally (or alternatively) include any combination of the following: the mud motor ΔP sensor 52*a* and the torque sensor(s) 52*b*. The mud motor ΔP sensor 52*a* is configured to detect a pressure differential value or range across one or more motors 52 of the BHA 38 and may comprise one or more individual pressure sensors and/or a comparison tool. The motor(s) 52 may each be or include a positive displacement drilling motor that uses hydraulic power of the drilling fluid to drive the drill bit 40 (also known as a mud motor). The torque sensor(s) 52*b* may also be included in the BHA 38 for sending data to the control system 50 that is indicative of the torque applied to the drill bit 40 by the motor(s) 52.

Figure 2:
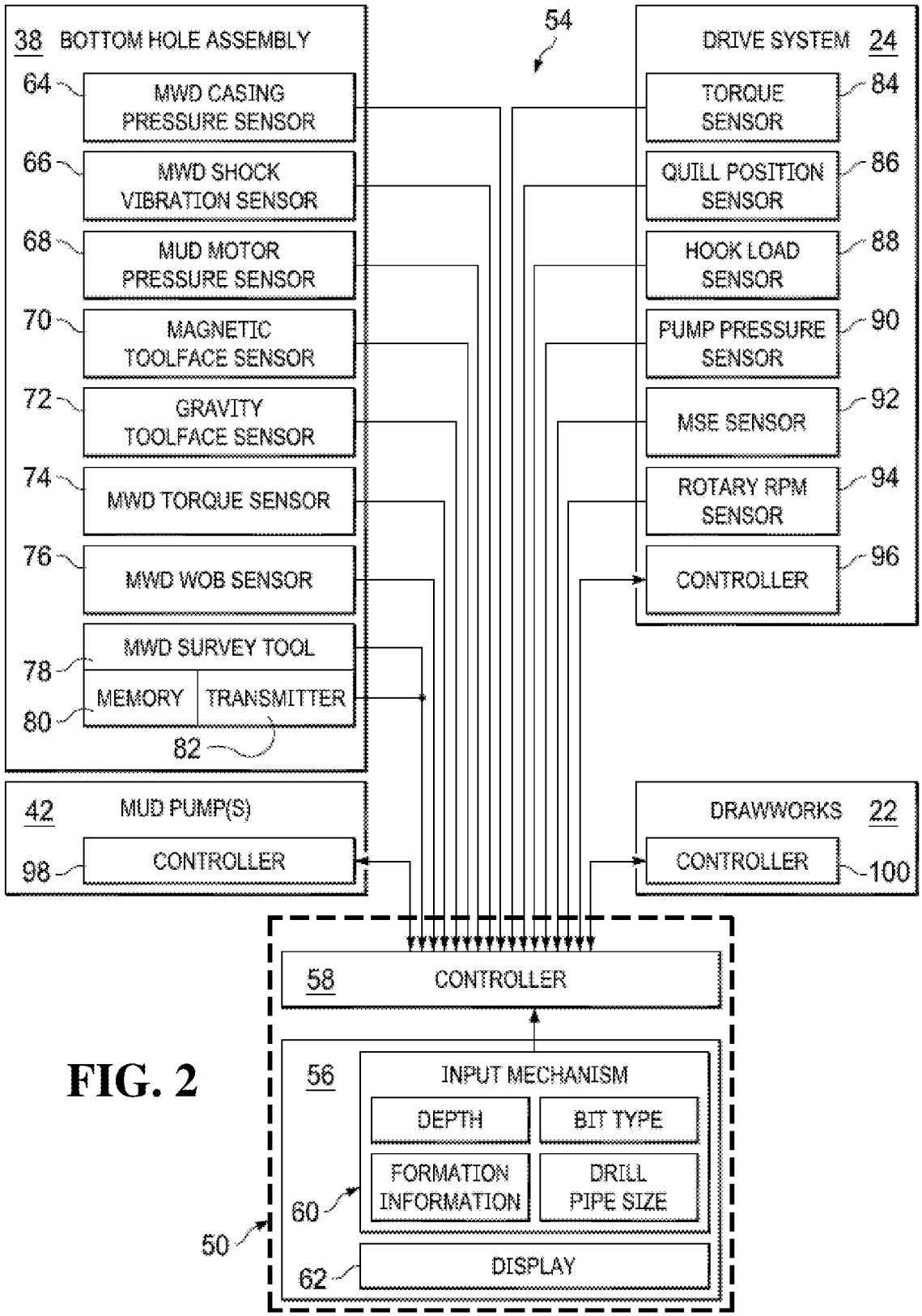
FIG. 2 is a diagrammatic illustration of an apparatus that may be implemented within the environment and/or the drilling rig of FIG. 1, according to one or more embodiments of the present disclosure.

Referring to FIG. 2, an apparatus is diagrammatically shown and generally referred to by the reference numeral 54. The apparatus 54 includes at least respective parts of the drilling rig 10, including, but not limited to, the control system 50, the drawworks 22, the top drive 24 (identified as a "drive system"), the BHA 38, and the mud pump(s) 42. The apparatus 54 may be implemented within the environment and/or the drilling rig 10 of FIG. 1. The drilling rig 10 and the apparatus 54 may be collectively referred to as a "drilling system." As shown in FIG. 2, the control system 50 includes a user-interface 56 and a controller 58—depending on the embodiment, these may be discrete components that are interconnected via a wired or wireless link. The user-interface 56 and the controller 58 may additionally (or alternatively) be integral components of a single system. The user-interface 56 may include an input mechanism 60 that permits a user to input drilling settings or parameters such as, for example, left and right oscillation revolution settings (these settings control the drive system to oscillate a portion of the drill string 32), acceleration, toolface setpoints, rotation settings, a torque target value (such as a previously calculated torque target value that may determine the limits of oscillation), information relating to the drilling parameters of the drill string 32 (such as BHA information or arrangement, drill pipe size, bit type, depth, and formation information), and/or other setpoints and input data.

The input mechanism 60 may include a keypad, voice-recognition apparatus, dial, button, switch, slide selector, toggle, joystick, mouse, database, and/or any other suitable data input device. The input mechanism 60 may support data input from local and/or remote locations. In addition, or instead, the input mechanism 60, when included, may permit user-selection of predetermined profiles, algorithms, setpoint values or ranges, such as via one or more drop-down menus—this data may instead (or in addition) be selected by the controller 58 via the execution of one or more database look-up procedures. In general, the input mechanism 60 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other suitable techniques or systems. The user-interface 56 may also include a display 62 for visually presenting information to the user in textual, graphic, or video form. The display 62 may be utilized by the user to input drilling parameters, limits, or setpoint data in conjunction with the input mechanism 60—for example, the input mechanism 60 may be integral to or otherwise communicably coupled with the display 62.

The controller 58 may be configured to receive data or information from the user, the drawworks 22, the top drive 24, the BHA 38, and/or the mud pump(s) 42—the controller 58 processes such data or information to enable effective and efficient drilling.

The BHA 38 includes one or more sensors (typically a plurality of sensors) located and configured about the BHA 38 to detect parameters relating to the drilling environment, the condition and orientation of the BHA 38, and/or other information. For example, the BHA 38 may include an MWD casing pressure sensor 64, an MWD shock/vibration sensor 66, a mud motor ΔP sensor 68, a magnetic toolface sensor 70, a gravity toolface sensor 72, an MWD torque sensor 74, and an MWD weight-on-bit ("WOB") sensor 76—in some embodiments, one or more of these sensors is, includes, or is part of the following sensor(s) shown in FIG. 1: the downhole annular pressure sensor 38*a*, the shock/vibration sensor 38*b*, the toolface sensor 38*c*, the WOB sensor 38*d*, the mud motor ΔP sensor 52*a*, and/or the torque sensor(s) 52*b*.

The MWD casing pressure sensor 64 is configured to detect an annular pressure value or range at or near the MWD portion of the BHA 38. The MWD shock/vibration sensor 66 is configured to detect shock and/or vibration in the MWD portion of the BHA 38. The mud motor ΔP sensor 68 is configured to detect a pressure differential value or range across the mud motor of the BHA 38. The magnetic toolface sensor 70 and the gravity toolface sensor 72 are cooperatively configured to detect the current toolface. In some embodiments, the magnetic toolface sensor 70 is or includes a magnetic toolface sensor that detects toolface orientation relative to magnetic north or true north. In some embodiments, the gravity toolface sensor 72 is or includes a gravity toolface sensor that detects toolface orientation relative to the Earth's gravitational field. In some embodiments, the magnetic toolface sensor 70 detects the current toolface when the end of the wellbore 34 is less than about 7° from vertical, and the gravity toolface sensor 72 detects the current toolface when the end of the wellbore 34 is greater than about 7° from vertical. Other toolface sensors may also be utilized within the scope of the present disclosure that may be more or less precise (or have the same degree of precision), including non-magnetic toolface sensors and non-gravitational inclination sensors. The MWD torque sensor 74 is configured to detect a value or range of values for torque applied to the bit by the motor(s) of the BHA 38. The MWD weight-on-bit ("WOB") sensor 76 is configured to detect a value (or range of values) for WOB at or near the BHA 38.

The following data may be sent to the controller 58 via one or more signals, such as, for example, electronic signal via wired or wireless transmission, mud-pulse telemetry, another signal, or any combination thereof: the casing pressure data detected by the MWD casing pressure sensor 64, the shock/vibration data detected by the MWD shock/vibration sensor 66, the pressure differential data detected by the mud motor ΔP sensor 68, the toolface orientation data detected by the toolface sensors 70 and 72, the torque data detected by the MWD torque sensor 74, and/or the WOB data detected by the MWD WOB sensor 76. The pressure differential data detected by the mud motor ΔP sensor 68 may alternatively (or additionally) be calculated, detected, or otherwise determined at the surface, such as by calculating the difference between the surface standpipe pressure just off-bottom and the pressure measured once the bit touches bottom and starts drilling and experiencing torque.

The BHA 38 may also include a MWD survey tool 78—in some embodiments, the MWD survey tool 78 is, includes, or is part of the MWD survey tool 38*e* shown in FIG. 1. The MWD survey tool 78 may be configured to perform surveys at intervals along the wellbore 34, such as during drilling and tripping operations. The MWD survey tool 78 may include one or more gamma ray sensors that detect gamma data. The data from these surveys may be transmitted by the MWD survey tool 78 to the controller 58 through various telemetry methods, such as mud pulses. In other embodiments, survey data is collected and stored by the MWD survey tool 78 in an associated memory 80. This data may be uploaded to the controller 58 at a later time, such as when the MWD survey tool 78 is removed from the wellbore 34 or during maintenance. Some embodiments use alternative data gathering sensors or obtain information from other sources. For example, the BHA 38 may include sensors for making additional measurements, including, for example and without limitation, azimuthal gamma data, neutron density, porosity, and resistivity of surrounding formations. In some embodiments, such information may be obtained from third parties or may be measured by systems other than the BHA 38.

The BHA 38 may include a memory 80 and a transmitter 82. In some embodiments, the memory 80 and transmitter 82 are integral parts of the MWD survey tool 78, while in other embodiments, the memory 80 and transmitter 82 are separate and distinct modules. The memory 80 may be any type of memory device, such as a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, or other forms of volatile and non-volatile memory. The memory 80 may be configured to store readings and measurements for some period of time. In some embodiments, the memory 80 is configured to store the results of surveys performed by the MWD survey tool 78 for some period of time, such as the time between drilling connections, or until the memory 80 may be downloaded after a tripping out operation. The transmitter 82 may be any type of device to transmit data from the BHA 38 to the controller 58, and may include a mud pulse transmitter. In some embodiments, the MWD survey tool 78 is configured to transmit survey results in real-time to the surface through the transmitter 82. In other embodiments, the MWD survey tool 78 is configured to store survey results in the memory 80 for a period of time, access the survey results from the memory 80, and transmit the results to the controller 58 through the transmitter 82.

The top drive 24 includes one or more sensors (typically a plurality of sensors) located and configured about the top drive 24 to detect parameters relating to the condition and orientation of the drill string 32, and/or other information. For example, the top drive 24 may include a rotary torque sensor 84, a quill position sensor 86, a hook load sensor 88, a pump pressure sensor 90, a mechanical specific energy ("MSE") sensor 92, and a rotary RPM sensor 94—in some embodiments, one or more of these sensors is, includes, or is part of the following sensor shown in FIG. 1: the torque sensor 24*a*, the speed sensor 24*b*, the WOB sensor 24*c*, and/or the casing annular pressure sensor 48. In addition to, or instead of, being included as part of the drive system 24, the pump pressure sensor 90 may be included as part of the mud pump(s) 42. The top drive 24 also includes a controller 96 for controlling the rotational position, speed, and direction of the quill 28 and/or another component of the drill string 32 coupled to the top drive 24. The controller 96 may be, include, or be part of the controller 58, or another controller.

The rotary torque sensor 84 is configured to detect a value (or range of values) for the reactive torsion of the quill 28 or the drill string 32. The quill position sensor 86 is configured to detect a value (or range of values) for the rotational position of the quill 28 (e.g., relative to true north or another stationary reference). The hook load sensor 88 is configured to detect the load on the hook 26 as it suspends the top drive 24 and the drill string 32. The pump pressure sensor 90 is configured to detect the pressure of the mud pump(s) 42 providing mud or otherwise powering the BHA 38 from the surface. In some embodiments, rather than being included as part of the top drive 24, the pump pressure sensor 90 may be incorporated into, or included as part of, the mud pump(s) 42. The MSE sensor 92 is configured to detect the MSE representing the amount of energy required per unit volume of drilled rock—in some embodiments, the MSE is not directly detected, but is instead calculated at the controller 58 (or another controller) based on sensed data. The rotary RPM sensor 94 is configured to detect the rotary RPM of the drill string 32—this may be measured at the top drive 24 or elsewhere (e.g., at surface portion of the drill string 32). The following data may be sent to the controller 58 via one or more signals, such as, for example, electronic signal via wired or wireless transmission: the rotary torque data detected by the rotary torque sensor 84, the quill position data detected by the quill position sensor 86, the hook load data detected by the hook load sensor 88, the pump pressure data detected by the pump pressure sensor 90, the MSE data detected (or calculated) by the MSE sensor 92, and/or the RPM data detected by the RPM sensor 94.

The mud pump(s) 42 include a controller 98 and/or other means for controlling the pressure and flow rate of the drilling mud produced by the mud pump(s) 42—such control may include torque and speed control of the mud pump(s) 42 to manipulate the pressure and flow rate of the drilling mud and the ramp-up or ramp-down rates of the mud pump(s) 42. As discussed above, the mud pump(s) 42 may include the pump pressure sensor 90. Additionally, a pump flow sensor (shown) may be included as part of the mud pump(s) 42 or the drive system 24. In some embodiments, the controller 98 is, includes, or is part of the controller 58.

The drawworks 22 include a controller 100 and/or other means for controlling feed-out and/or feed-in of the drilling line 20 (shown in FIG. 1)—such control may include rotational control of the drawworks to manipulate the height or position of the hook and the rate at which the hook ascends or descends. The drill string feed-off system of the drawworks 22 may instead be a hydraulic ram or rack and pinion type hoisting system rig, where the movement of the drill string 32 up and down is facilitated by something other than a drawworks. The drill string 32 may also take the form of coiled tubing, in which case the movement of the drill string 32 in and out of the wellbore 34 is controlled by an injector head which grips and pushes/pulls the tubing in/out of the wellbore 34. Such embodiments still include a version of the controller 100 configured to control feed-out and/or feed-in of the drill string 32. In some embodiments, the controller 100 is, includes, or is part of the controller 58.

The controller 58 may be configured to receive data or information relating to one or more of the above-described parameters from the user-interface 56, the BHA 38 (including the MWD survey tool 78), the top drive 24, the mud pump(s) 42, and/or the drawworks 22, as described above, and to utilize such information to enable effective and efficient drilling. In some embodiments, the parameters are transmitted to the controller 58 by one or more data channels. In some embodiments, each data channel may carry data or information relating to a particular sensor. The controller 58 may be further configured to generate a control signal, such as via intelligent adaptive control, and provide the control signal to the top drive 24, the mud pump(s) 42, and/or the drawworks 22 to adjust and/or maintain one or more of the following: the rotational position, speed, and direction of the quill 28 and/or another component of the drill string 32 coupled to the top drive 24, the pressure and flow rate of the drilling mud produced by the mud pump(s) 42, and the feed-out and/or feed-in of the drilling line 20. Moreover, the controller 96 of the top drive 24, the controller 98 of the mud pump(s) 42, and/or the controller 100 of the drawworks 22 may be configured to generate and transmit a signal to the controller 58—these signal(s) influence the control of the top drive 24, the mud pump(s) 42, and/or the drawworks 22. In addition, or instead, any one of the controllers 96, 98, and 100 may be configured to generate and transmit a signal to another one of the controllers 96, 98, or 100, whether directly or via the controller 58—as a result, any combination of the controllers 96, 98, and 100 may be configured to cooperate in controlling the top drive 24, the mud pump(s) 42, and/or the drawworks 22.

Figure 3:
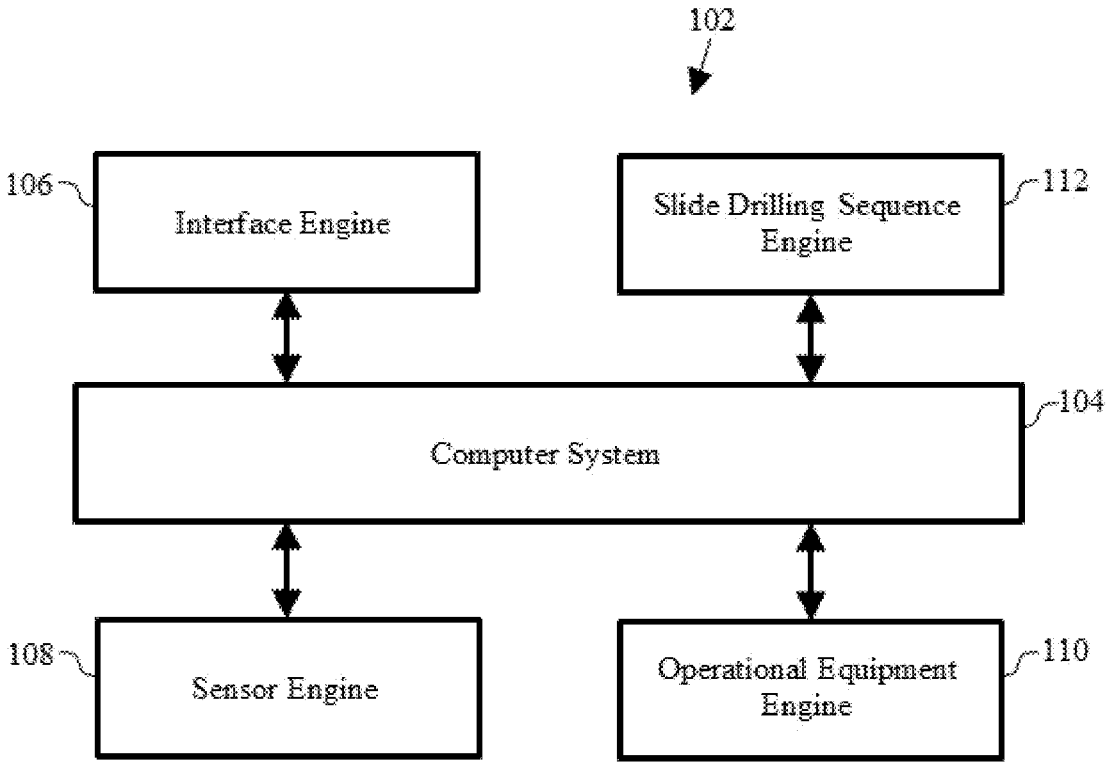
FIG. 3 is a diagrammatic illustration of a rig control system including a computer system, an interface engine, a sensor engine, an operational equipment engine, and slide drilling sequence engine, according to one or more embodiments of the present disclosure.

Referring to FIG. 3, a rig control system is diagrammatically illustrated and generally referred to by the reference numeral 102. The rig control system 102 may be, include, or be part of the following components, among others: the control system 50, the drawworks 22, the top drive 24, the BHA 38, and/or the mud pump(s) 42, or any combination thereof. For example, in some embodiments, the rig control system 102 includes a combination (or sub-combination) of the controllers 58, 96, 98, and 100. The rig control system 102 may be implemented within the environment and/or the drilling rig 10 of FIG. 1, and/or within the environment and/or the apparatus 54 of FIG. 2. The rig control system 102 includes a computer system 104 coupled to an interface engine 106, a sensor engine 108, an operational equipment engine 110, and a slide drilling sequence engine 112. The computer system 104 may include, or be part of, the interface engine 106, the sensor engine 108, the operational equipment engine 110, the slide drilling sequence engine 112, or any combination thereof.

The term "engine" is meant herein to refer to an agent, instrument, or combination of either, or both, agents and instruments that may be associated to serve a purpose or accomplish a task—agents and instruments may include sensors, actuators, switches, relays, valves, power plants, system wiring, equipment linkages, specialized operational equipment, computers, components of computers, programmable logic devices, microprocessors, software, software routines, software modules, communication equipment, networks, network services, and/or other elements and their equivalents that contribute to the purpose or task to be accomplished by the engine. Accordingly, some of the engines may be software modules or routines, while others of the engines may be hardware elements in communication with the computer system 104. The computer system 104 operates to control the interaction of data with and between the other components of the rig control system 102.

The interface engine 106 includes at least one input and output device or system that enables a user to interact with the computer system 104 and the functions that the computer system 104 provides. In some embodiments, the interface engine 106 includes at least the following component: the user-interface 56 (shown in FIG. 2). However, the interface engine 106 may have multiple user stations, which may include a video display, a keyboard, a pointing device, a document scanning/recognition device, or other device configured to receive an input from an external source, which may be connected to a software process operating as part of a computer or local area network. The interface engine 106 may include externally positioned equipment configured to input data into the computer system 104. Data entry may be accomplished through various forms, including raw data entry, data transfer, or document scanning coupled with a character recognition process, for example. The interface engine 106 may include a user station that has a display with touch-screen functionality, so that a user may receive information from the rig control system 102, and provide input to the rig control system 102 directly via the display or touch screen. Other examples of sub-components that may be part of the interface engine 106 include, but are not limited to, audible alarms, visual alerts, telecommunications equipment, and computer-related components, peripherals, and systems.

Sub-components of the interface engine 106 may be positioned in various locations within an area of operation, such as on a drilling rig at a drill site. Sub-components of the interface engine 106 may also be remotely located away from the general area of operation, for example, at a business office, at a sub-contractor's office, in an operations manager's mobile phone, and in a sub-contractor's communication linked personal data appliance. A wide variety of technologies would be suitable for providing coupling of various sub-components of the interface engine 106 and the interface engine 106 itself to the computer system 104. In some embodiments, the operator may thus be remote from the interface engine 106, such as through a wireless or wired internet connection, or a portion of the interface engine 106 may be remote from the rig, or even the wellsite, and be proximate a remote operator, and the portion thus connected through, e.g., an internet connection, to the remainder of the on-site components of the interface engine 106.

The sensor engine 108 may include devices such as sensors, meters, detectors, or other devices configured to measure or sense a parameter related to a component of a well drilling operation—in some embodiments, the sensor engine 108 includes one or more of the following components (shown in FIGS. 1 and 2), among others: the torque sensor 24*a*, the speed sensor 24*b*, the WOB sensor 24*c*, the downhole annular pressure sensor 38*a*, the shock/vibration sensor 38*b*, the toolface sensor 38*c*, the WOB sensor 38*d*, the surface casing annular pressure sensor 48, the mud motor ΔP sensor 52*a*, the torque sensor(s) 52*b*, the MWD casing pressure sensor 64, the MWD shock/vibration sensor 66, the mud motor ΔP sensor 68, the magnetic toolface sensor 70, the gravity toolface sensor 72, the MWD torque sensor 74, the MWD WOB sensor 76, the MWD survey tool 78, the rotary torque sensor 84, the quill position sensor 86, the hook load sensor 88, the pump pressure sensor 90, the MSE sensor 92, and the rotary RPM sensor 94. The sensors or other detection devices are generally configured to sense or detect activity, conditions, and circumstances in an area to which the device has access. These sensors may be located on the surface or downhole, and configured to transmit information to the surface through a variety of methods.

Sub-components of the sensor engine 108 may be deployed at any operational area where information on the execution of one or more drilling operations may occur. Readings from the sensor engine 108 are fed back to the computer system 104. The reported data may include the sensed data, or may be derived, calculated, or inferred from sensed data. Sensed data may be that concurrently collected, recently collected, or historically collected, at that wellsite or an adjacent wellsite. The computer system 104 may send signals to the sensor engine 108 to adjust the calibration or operational parameters in accordance with a control program in the computer system 104, which control program is generally based upon the objectives set forth in the wellplan. Additionally, the computer system 104 may generate outputs that control the well drilling operation, as described in further detail below. The computer system 104 receives and processes data from the sensor engine 108 or from other suitable source(s), and monitors the rig and conditions on the rig based on the received data.

The operational equipment engine 110 may include a plurality of devices configured to facilitate accomplishment of the objectives set forth in the wellplan—in some embodiments, the operational equipment engine 110 includes one or more components of FIG. 1's drilling rig 10 and/or FIG. 2's apparatus 54. For example, the operational equipment engine 110 may include the drawworks 22, the top drive 24, the BHA 38, the mud pump(s) 42, and/or the control system 50. The objective of the operational equipment engine 110 is to drill a well in accordance with the specifications set forth in the wellplan. Therefore, the operational equipment engine 110 may include hydraulic rams, rotary drives, valves, solenoids, agitators, drives for motors and pumps, control systems, and any other tools, machines, equipment, or the like that would be required to drill the well in accordance with the wellplan. The operational equipment engine 110 may be designed to exchange communication with computer system 104, so as to not only receive instructions, but to provide information on the operation of the operational equipment engine 110 apart from any associated sensor engine 108. For example, encoders associated with the top drive 24 may provide rotational information regarding the drill string 32, and hydraulic links may provide height, positional information, or a change in height or positional information. The operational equipment engine 110 may be configured to receive control inputs from the computer system 104 and to control the well drilling operation (i.e., the components conducting the well drilling operation) in accordance with the received inputs from the computer system 104.

The computer system 104, the interface engine 106, the sensor engine 108, and the operational equipment engine 110 should be fully integrated with the wellplan to assure proper operation and safety. Moreover, measurements of the rig operating parameters (block position, hook load, pump pressure, slips set, etc.) should have a high level of accuracy to enable proper accomplishment of the wellplan with minimal or no human intervention once the operational parameters are selected and the control limits are set for a given drilling operation, and the trigger(s) are pre-set to initiate the operation.

Figure 4:
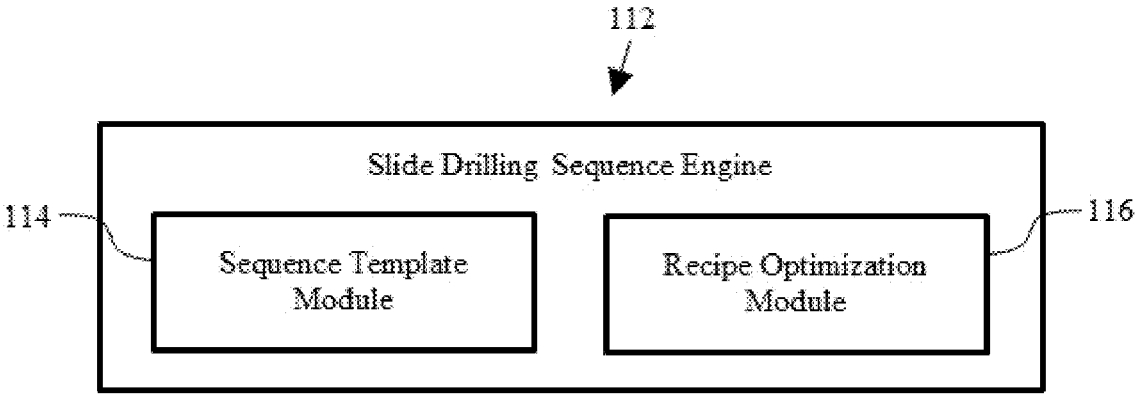
FIG. 4 is a diagrammatic illustration of the slide drilling sequence engine of FIG. 3, the slide sequence engine including a sequence template module and a recipe optimization module, according to one or more embodiments of the present disclosure.

Referring to FIG. 4, an embodiment of the slide drilling sequence engine 112 is schematically illustrated—in the embodiment shown, the slide drilling sequence engine 112 includes a sequence template module 114 and a recipe optimization module 116. The sequence template module 114 and the recipe optimization module 116, in combination, are configured to improve the process of slide drilling a stand down in accordance with the wellplan. In general, the process of slide drilling a stand down begins when the stand connection is made up and ends when the stand has been drilled and set back in slips at connection height. This process is divided into a series of tasks, which may include one or more of the following tasks, among others: making up the stand connection, transitioning from slips-to-weight, removing trapped torque from the drill string, tagging bottom, oscillating the drill string to break friction, obtaining the target toolface orientation, maintaining the target toolface orientation, drilling the stand to completion, reaming the drilled hole section, and setting the stand in slips at connection height. To enable effective and efficient drilling in accordance with the wellplan, various combinations of these tasks may be carried out in different ways for each stand (or portion thereof) in the drill string 32. To this end, the sequence template module 114 includes sequence template(s) that may be completed in advance to facilitate the completing of these tasks—such sequence template(s) may include a variety of operational steps and parameters for which setpoints and/or operational limits are needed to accomplish a specific task.

Figure 5:
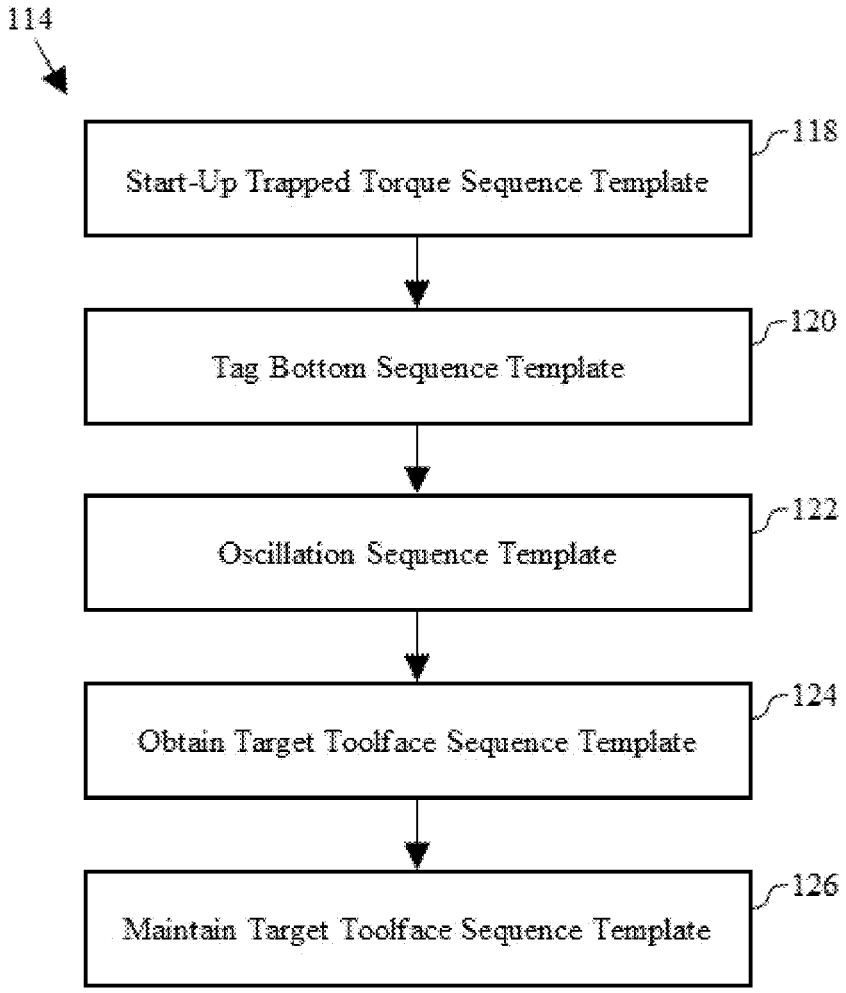
FIG. 5 is a flow diagram illustrating the sequence template module of FIG. 4, the sequence template module including a start-up trapped torque sequence template, a tag bottom sequence template, an oscillation sequence template, an obtain target toolface sequence template, and a maintain target toolface sequence template, according to one or more embodiments of the present disclosure.

Referring to FIG. 5, in an embodiment, the sequence template module 114 includes a start-up trapped torque sequence template 118, a tag bottom sequence template 120, an oscillation sequence template 122, an obtain target toolface sequence template 124, and a maintain target toolface sequence template 126. Different combinations of these sequence template(s) can partially or fully activated or deactivated when a particular hole section is reached (e.g., surface hole, intermediate hole, or production hole), or when a certain predefined event occurs (e.g., circulate a kick or trip out of hole to change a bit). In some embodiments, one or more of these sequence template(s) can be activated or deactivated by the rig control system 102 after it receives information from the sensor engine 108 indicating that the particular hole section has been reached, the predefined event has occurred, or some other condition exists.

The various sequence template(s) provide a framework for completing the process of slide drilling a stand down, but require the input of specific combinations of parameters and/or control limits before the process can be carried out (referred to herein as "recipes")—embodiments of these sequence templates are described in further detail below. The recipes may be specific to a particular hole section (e.g., the surface hole, the intermediate hole, or the production hole), a complex or specific geological layer through which the drilling is expected to proceed, and/or another characteristic of the well. In addition, or instead, the recipes may set the control limits of the drilling rig and can include sign-off, dates and times of creation, and dates and times of implementing, within the rig control system 102 (or another control system). The recipes will be described in further detail below in connection with the recipe optimization module 116.

Figure 6:
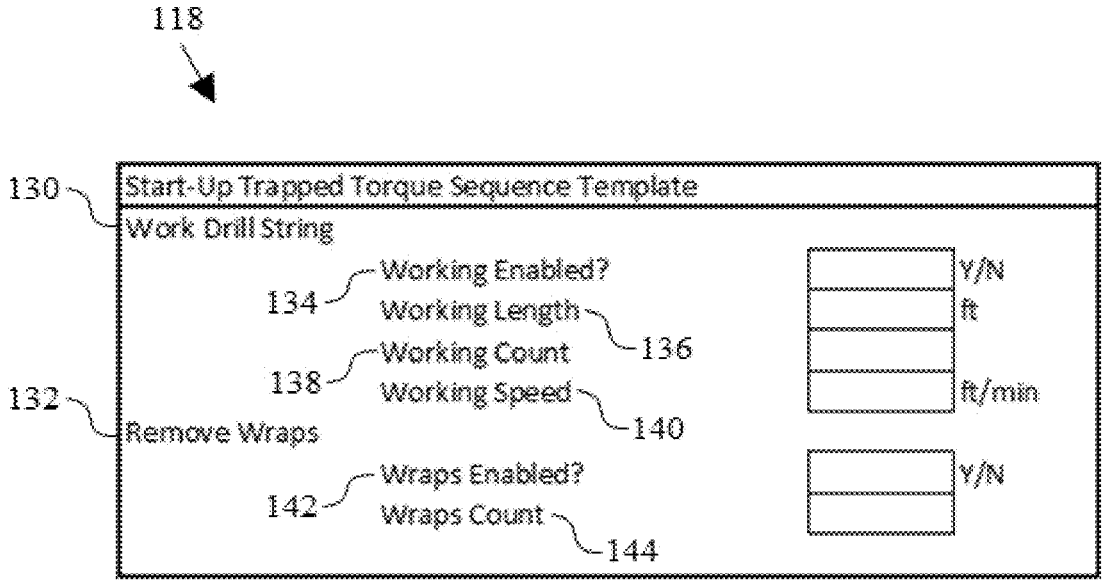
FIG. 6 illustrates an exemplary "screen shot" of the start-up trapped torque sequence template FIG. 5, according to one or more embodiments of the present disclosure.

Referring to FIG. 6, an embodiment of the start-up trapped torque sequence template 118 is illustrated—in the process of slide drilling a stand down, this sequence template facilitates the task of removing trapped torque from the drill string 32. In the embodiment shown, the start-up trapped torque sequence template 118 includes a subtemplate 130 for working the drill string 32 up and down, and a subtemplate 132 for removing wraps from the drill string 32.

The subtemplate 130 includes data fields for the following parameters and/or control limits: a selector 134 to enable or disable the removal of trapped torque by working the drill string 32 up and down, a working length setpoint 136 (in feet), a working count setpoint 138, and a working speed setpoint 140 (in ft/min). The working length setpoint 136 sets a distance to move the drill string 32 up and down using the drawworks 22 if the selector 134 is enabled. The work count setpoint 138 sets the number of times to move the drill string 32 up and down using the drawworks 22 if the selector 134 is enabled. The work speed setpoint 140 sets the speed at which to move the drill string 32 up and down using the drawworks 22 if the selector 134 is enabled.

The subtemplate 132 includes data fields for the following parameters and/or control limits: a selector 142 to enable or disable the removal of trapped torque by removing wraps from the drill string 32, and a wraps count setpoint 144. The wraps count setpoint 144 sets the number of counterclockwise revolutions to rotate the drill string 32 from the surface using the top drive 24 if the selector 142 is enabled. In some embodiments, only one of the selectors 134 and 142 can be enabled at a time.

Figure 7:
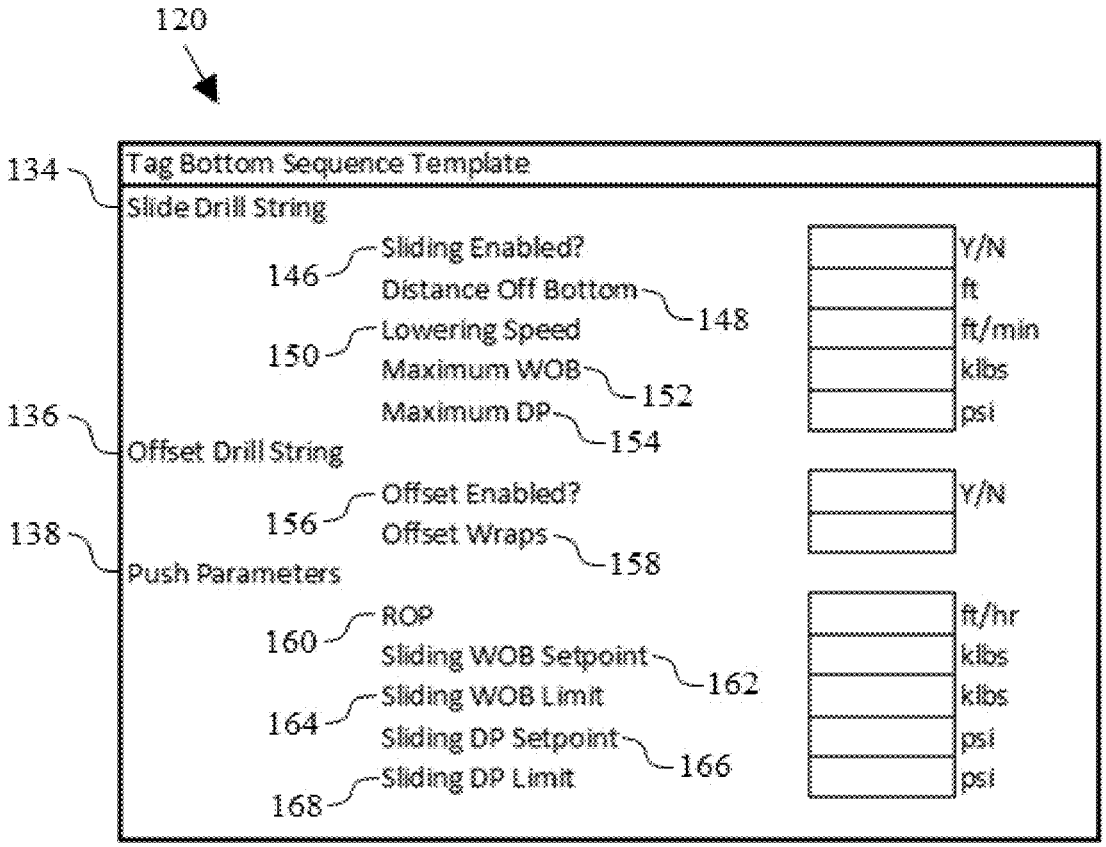
FIG. 7 illustrates an exemplary "screen shot" of the tag bottom sequence template of FIG. 5, according to one or more embodiments of the present disclosure.

Referring to FIG. 7, an embodiment of the tag bottom sequence template 120 is illustrated—in the process of slide drilling a stand down, this sequence template facilitates the task of tagging bottom in the wellbore 34 in a controlled manner. In the embodiment shown, the tag bottom sequence template 120 includes a subtemplate 134 for sliding the drill string 32 to tag bottom, a subtemplate 136 for offsetting the drill string 32 to account for reactive torque, and a subtemplate 138 for pushing one or more slide drilling parameters to the operational equipment engine 110.

The subtemplate 134 includes data fields for the following parameters and/or control limits: a selector 146 to enable or disable the sliding of the drill string 32 to tag bottom, a distance off bottom setpoint 148 (in ft), a lowering speed setpoint 150 (in ft/min), a maximum WOB setpoint 152 (in klbs), and a maximum differential pressure setpoint 154 (in psi). The distance off bottom setpoint 148 sets the distance from the bottom of the wellbore 34 at which the operational equipment engine 110 will initiate slide drilling. The lowering speed setpoint 150 sets the speed at which the drawworks 22 lowers the drill pipe into the wellbore 34 before slide drilling is initiated. The maximum WOB setpoint 152 sets the sensed WOB at which the operational equipment engine 110 will initiate slide drilling. The maximum differential pressure setpoint 154 sets the sensed differential pressure at which the operational equipment engine 110 will initiate slide drilling. In some embodiments, if the selector 146 is enabled, slide drilling will be initiated as soon as any one of the following parameters has been achieved: the distance off bottom setpoint 148, the maximum WOB setpoint 152, or the maximum differential pressure setpoint 154. In some embodiments, the sensor engine 108 is capable of sensing WOB and differential pressure in a manner that enables the operational equipment engine 110 to adhere to the maximum WOB setpoint 152 and the maximum differential pressure setpoint 154.

The subtemplate 136 includes data fields for the following parameters and/or control limits: a selector 156 to enable or disable the offsetting of the drill string 32 to account for reactive torque when tagging bottom, and an offset wraps setpoint 158. The offset wraps setpoint 158 sets the number of clockwise revolutions to rotate the drill string 32 from the surface using the top drive 24 if the selector 156 is enabled. In some embodiments, if the selector 156 is enabled, offset wraps will be added to the drill string 32 using the top drive 24 in accordance with the offset wraps setpoint 158 as soon as one of the following has been achieved: the distance off bottom setpoint 148, the maximum WOB setpoint 152, or the maximum differential pressure setpoint 154.

The subtemplate 138 includes data fields for the following parameters and/or control limits: a rate-of-penetration ("ROP") setpoint 160 (in ft/hr), a WOB sliding setpoint 162

(in klbs), a WOB sliding limit 164 (in klbs), a differential pressure sliding setpoint 166 (in psi), and a differential pressure sliding limit 168 (in psi). The ROP setpoint 160 sets an ROP at which the drawworks 22 will lower the drill string 32 into the wellbore 34 during slide drilling. The WOB sliding setpoint 162 sets a WOB for the drawworks 22 to maintain during slide drilling. The WOB sliding limit 164 sets the maximum permissible WOB during slide drilling. The differential pressure sliding setpoint 166 sets a differential pressure amount for the mud pump(s) to maintain during slide drilling. The differential pressure sliding limit 168 sets the maximum permissible differential pressure during slide drilling. In some embodiments, the sensor engine 108 is capable of sensing ROP, WOB, and differential pressure in a manner that enables the operational equipment engine 110 to maintain the ROP setpoint 160, the WOB sliding setpoint 162, and the differential pressure sliding setpoint 166, and to monitor the WOB sliding limit 164 and the differential pressure sliding limit 168.

Figure 8:
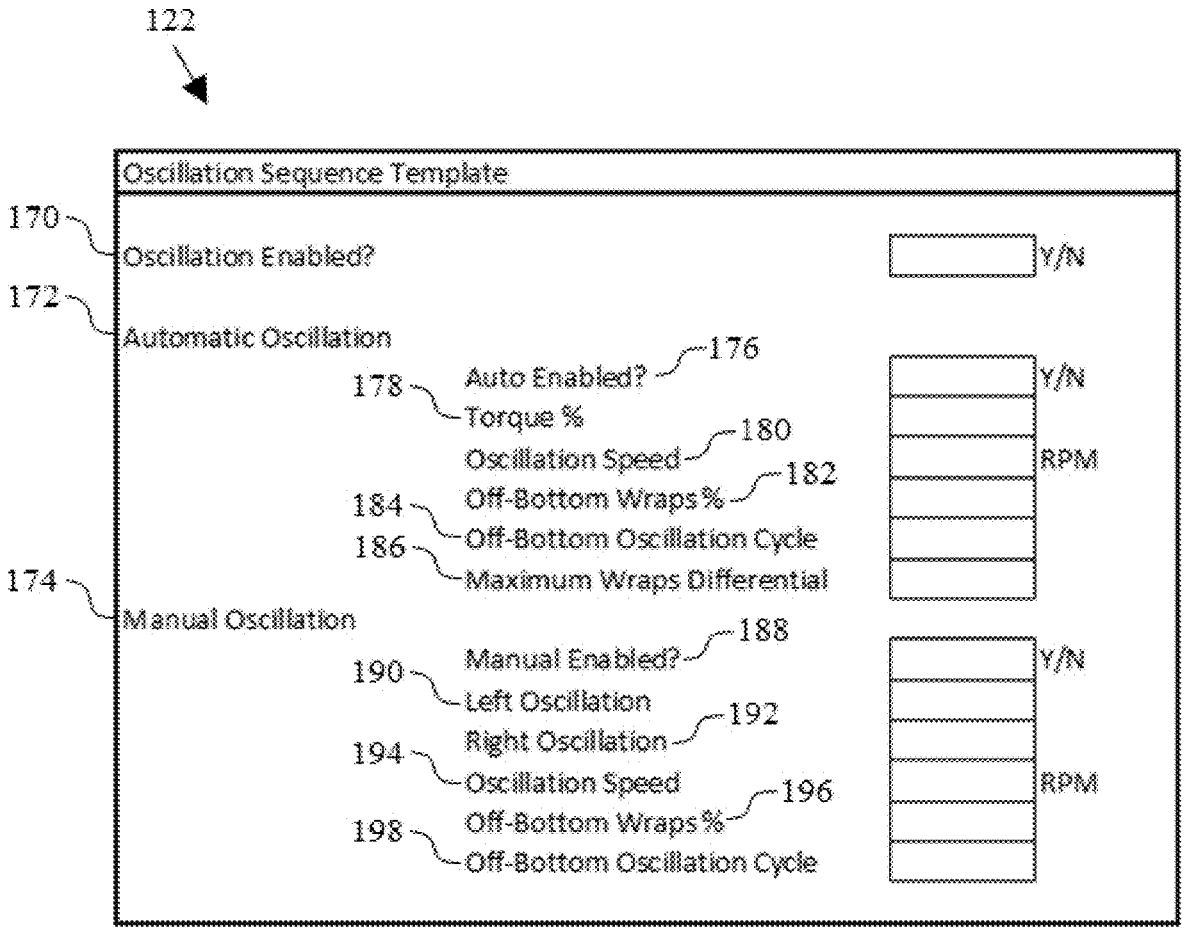
FIG. 8 illustrates an exemplary "screen shot" of the oscillation sequence template of FIG. 5, according to one or more embodiments of the present disclosure.

Referring to FIG. 8, an embodiment of the oscillation sequence template 122 is illustrated—in the process of slide drilling a stand down, this sequence template facilitates the task of oscillating the drill string 32 to break friction with the wellbore 34. In the embodiment shown, the oscillation sequence template 122 includes a selector 170 to enable or disable oscillation of the drill string 32, a subtemplate 172 for automatically oscillating the drill string 32, and a subtemplate 174 for manually oscillating the drill string 32.

The subtemplate 172 includes data fields for the following parameters and/or control limits: a selector 176 to enable or disable automatic oscillation of the drill string 32, a torque percentage setpoint 178, an oscillation speed setpoint 180 (in RPM), an off-bottom wraps percentage setpoint 182, an off-bottom oscillation cycle setpoint 184, and a maximum wraps differential setpoint 186. In some embodiments, the selector 176 cannot be enabled if the selector 170 is disabled. The torque percentage setpoint 178 sets a wrap quantity for on-bottom oscillation based on a percentage of the off-bottom rotary torque measured by the sensor engine 108. The oscillation speed setpoint 180 sets the speed at which the top drive 24 will oscillate the drill string 32 if the selector 176 is enabled. The off-bottom wraps percentage setpoint 182 sets a wrap quantity for off-bottom oscillation based on a percentage of the wrap quantity for on-bottom oscillation so as not to oscillate at full rotation before tagging bottom. The off-bottom oscillation cycle setpoint 184 sets the number of oscillation cycles to be completed before tagging bottom. The maximum wraps differential setpoint 186 sets a limit on how much greater the left (or counterclockwise) wrap quantity can be than the right (or clockwise) wrap quantity—in this manner, the maximum wraps differential setpoint 186 serves as a safety measure to maintain the integrity of connections in the drill string 32.

If the selectors 170 and 176 are enabled, the sensor engine 108 will measure the off-bottom rotary torque during rotary drilling periods. Then, before initiating slide drilling, the top drive 24 will rotate the drill string 32 to the right (clockwise) at the oscillation speed setpoint 180 until the sensor engine 108 indicates that the torque percentage setpoint 178 has been achieved. The top drive 24 will then rotate the drill string 32 to the left (counterclockwise) until either the torque percentage setpoint 178 has been achieved or the maximum wraps differential setpoint 186 has been achieved, whichever is first. The number of revolutions to the left and right during this process are recorded for use during on-bottom oscillation. Before tagging bottom, the top drive 24 will rotate the drill string 32 according to the off-bottom wraps percentage setpoint 182 and the off-bottom oscillation cycle setpoint 184. After tagging bottom, the top drive 24 will rotate the drill string 32 according to the left and right revolution values recorded for use during on-bottom oscillation.

The subtemplate 174 includes data fields for the following parameters and/or control limits: a selector 188 to enable or disable manual oscillation of the drill string 32, a left (or counterclockwise) oscillation setpoint 190 (in revolutions), a right (or clockwise) oscillation setpoint 192 (in revolutions), an oscillation speed setpoint 194 (in RPM), an off-bottom wraps percentage setpoint 196, and an off-bottom oscillation cycle setpoint 198. In some embodiments, the selector 188 cannot be enabled if the selector 170 is disabled. In some embodiments, only one of the selectors 176 and 188 can be enabled at a time, and neither of the selectors can be enabled if the selector 170 is disabled. The left (or counterclockwise) oscillation setpoint 190 set the number of wraps the top drive 24 with rotate the drill string 42 counterclockwise from the surface if the selector 188 is enabled. The right (or clockwise) oscillation setpoint 192 set the number of wraps the top drive 24 with rotate the drill string 42 clockwise from the surface if the selector 188 is enabled. The oscillation speed setpoint 194 sets the speed at which the top drive 24 will oscillate the drill string 32 if the selector 188 is enabled. The off-bottom wraps percentage setpoint 196 sets a wrap quantity for off-bottom oscillation based on a percentage of the wrap quantity for on-bottom oscillation so as not to oscillate at full rotation before tagging bottom. The off-bottom oscillation cycle setpoint 198 sets the number of oscillation cycles to be completed before tagging bottom.

If the selectors 170 and 188 are enabled, before tagging bottom, the top drive 24 will rotate the drill string 32 according to the off-bottom wraps percentage setpoint 196 and the off-bottom oscillation cycle setpoint 198. After tagging bottom, the top drive 24 will rotate the drill string 32 according to the left (or counterclockwise) oscillation setpoint 190 and the right (or clockwise) oscillation setpoint 192.

Figure 9:
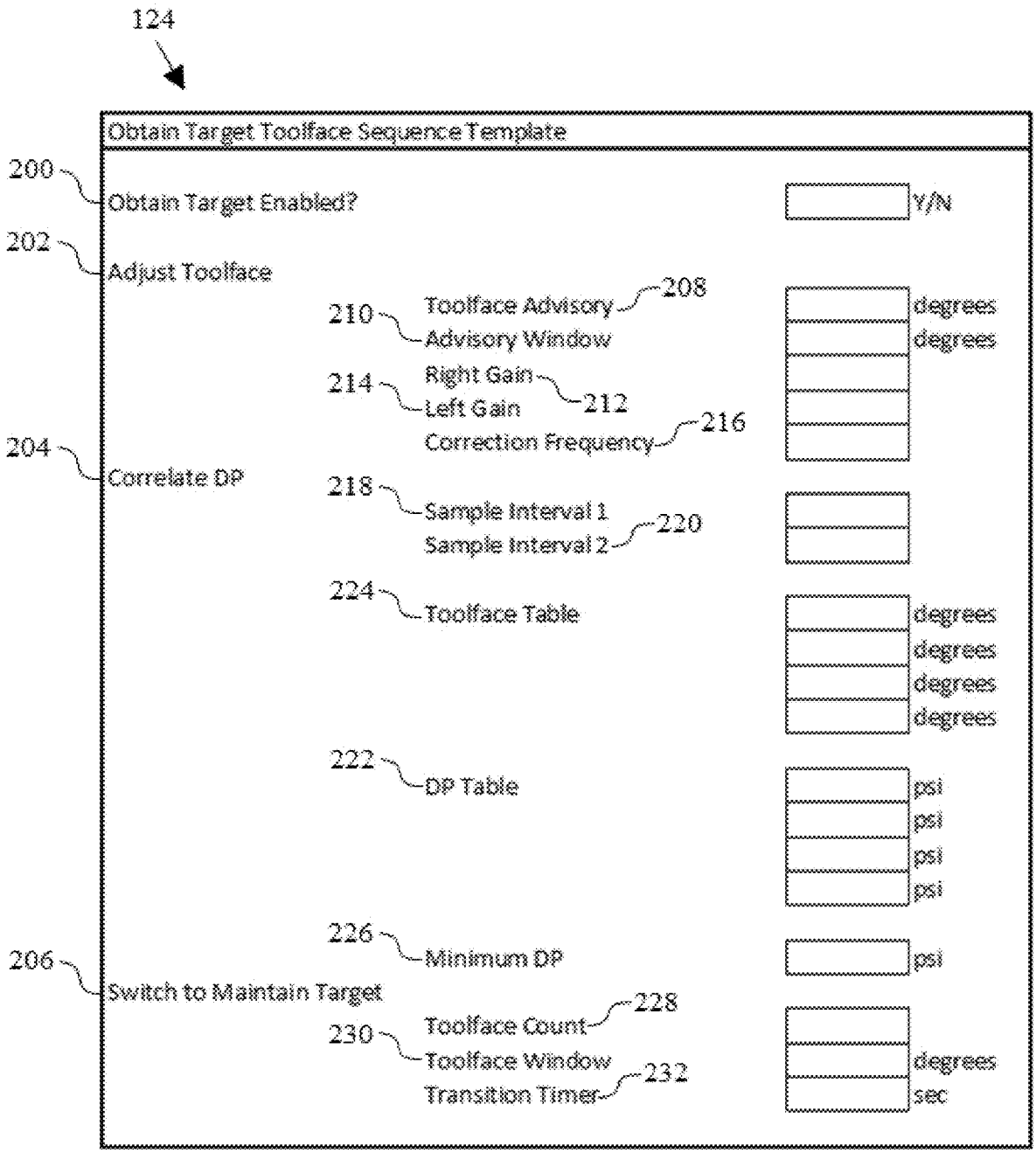
FIG. 9 illustrates an exemplary "screen shot" of the obtain target toolface sequence template of FIG. 5, according to one or more embodiments of the present disclosure.

Referring to FIG. 9, an embodiment of the obtain target toolface sequence template 124 is illustrated—in the process of slide drilling a stand down, this sequence template facilitates the task of obtaining the target toolface orientation in the wellbore 34 before slide drilling has been initiated. In the embodiment shown, the obtain target toolface sequence template 124 includes a selector 200 to enable or disable the obtaining of the target toolface orientation before slide drilling has been initiated, a subtemplate 202 for adjusting the toolface orientation towards the target orientation, a subtemplate 204 for correlating toolface orientation with the differential pressure measured by the sensor engine 108, and a subtemplate 206 for transitioning to the task of maintaining the target toolface orientation in the wellbore 34 after slide drilling has been initiated.

The subtemplate 202 includes data fields for the following parameters and/or control limits: a toolface advisory setpoint 208 (in degrees), a toolface advisory window 209, a toolface count setpoint 210, a right gain setpoint 212, a left gain setpoint 214, and a correction frequency setpoint 216. The toolface advisory setpoint 208 sets the desired orientation of the toolface in the wellbore 34. The toolface advisory window 209 sets a desired range for the toolface orientation, outside of which corrections to the toolface orientation will be made by the operational equipment engine 110. The toolface count setpoint 210 delays the initial correction of the toolface orientation until after the set number of toolface orientation readings have been received from the sensor engine 108. The right gain setpoint 212 acts as a multiplier to fine-tune any clockwise toolface corrections to be made by the operational equipment engine 110. The left gain setpoint 214 acts as a multiplier to fine-tune any counter-clockwise toolface corrections to be made by the operational equipment engine 110. The correction frequency setpoint 216 sets the number of consecutive toolface orientation readings outside of the advisory window that must be received from the sensor engine 108 before a correction is made.

The subtemplate 204 includes data fields for the following parameters and/or control limits: a sample interval setpoint 218, a sample interval setpoint 220, a differential pressure table 222 (in psi), a toolface table 224 (in degrees), and a minimum differential pressure setpoint 226 (in psi). The sample interval 218 sets a first time window within which the differential pressure measured by the sensor engine 108 is averaged. The sample interval 220 sets a second time window within which the differential pressure measured by the sensor engine 108 is averaged. In some embodiments, the sample interval 218 is different than the sample interval 220 so that the average differential pressures measured by the sensor engine 108 during the respective sample intervals 218 and 220 can be compared to detect any increase or decrease in the differential pressure. The differential pressure table 222 and the toolface table 224 are used to correlate the toolface orientation measured by the sensor engine 108 with the differential pressure measured by the sensor engine 108 to facilitate corrections to the toolface orientation using the operational equipment engine 110 (i.e., the top drive 24 and the quill 28). This correlation permits proactive adjustments to the position of the quill 28 based on the differential pressure detected by the sensor engine 108. The minimum differential pressure setpoint 226 sets the amount of differential pressure change required to make an adjustment to the toolface orientation.

The subtemplate 206 includes data fields for the following parameters and/or control limits: a toolface count setpoint 228, a obtain toolface window 230, and a transition timer setpoint 232. The number of toolface orientation readings set by the toolface count setpoint 228 must fall within the range set by the obtain toolface window 230 by the time a period set by the transition timer setpoint 232 has passed, or else the rig control system 102 will transition to the task of maintaining the target toolface orientation in the wellbore 34 after slide drilling has been initiated.

Figure 10:
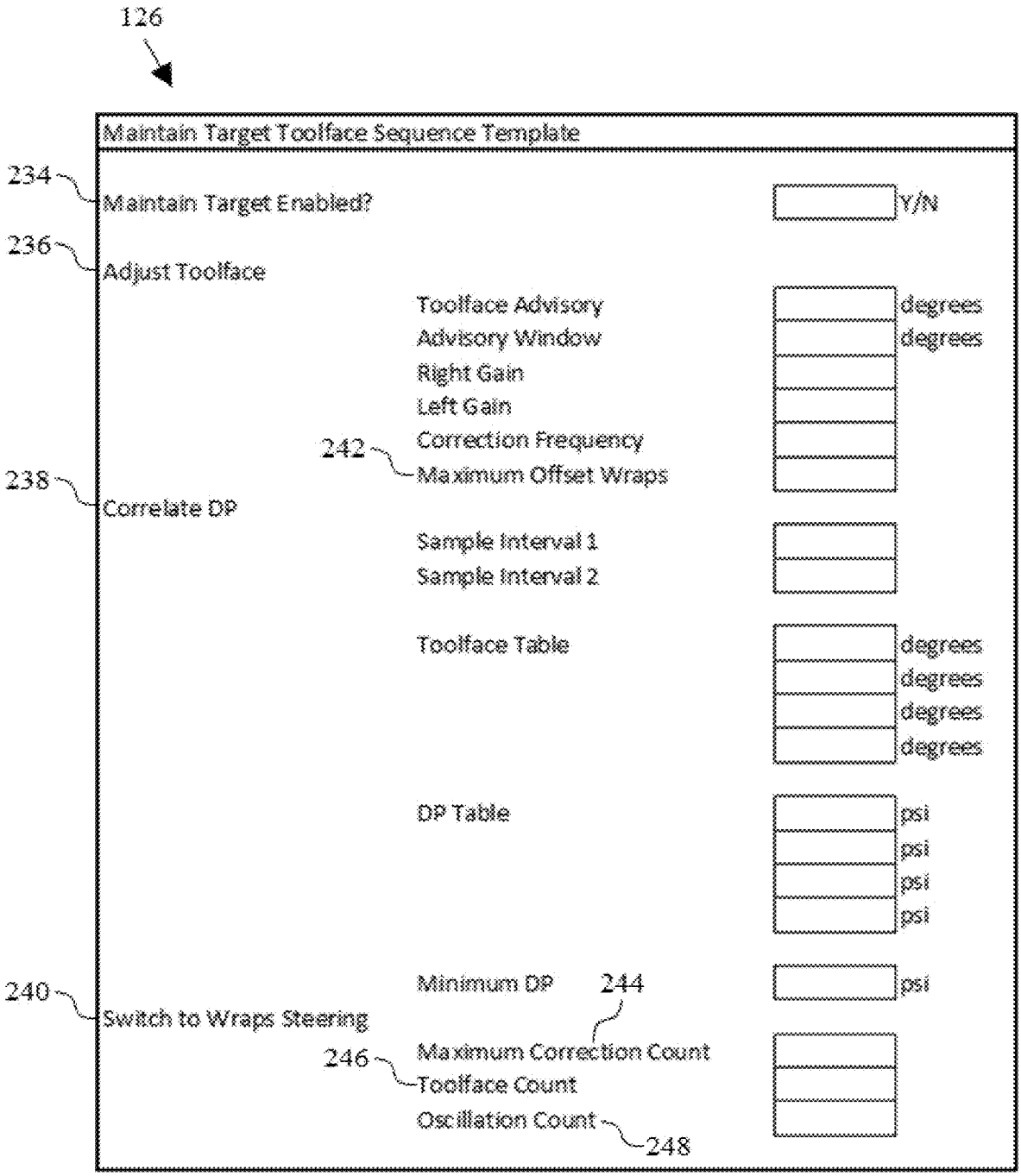
FIG. 10 illustrates an exemplary "screen shot" of the maintain target toolface sequence template of FIG. 5, according to one or more embodiments of the present disclosure.

Referring to FIG. 10, an embodiment of the maintain target toolface sequence template 126 is illustrated—in the process of slide drilling a stand down, this sequence template facilitates the task of maintaining the target toolface orientation in the wellbore 34 after slide drilling has been initiated. In the embodiment shown, the maintain target toolface sequence template 126 includes a selector 234 to enable or disable the maintaining of the target toolface orientation after slide drilling has been initiated, a subtemplate 236 for adjusting the toolface orientation towards the target orientation, a subtemplate 238 for correlating toolface orientation with the differential pressure measured by the sensor engine 108, and a subtemplate 240 for transitioning to oscillation-based toolface orientation corrections.

The subtemplate 236 is substantially identical to the subtemplate 202, except that the subtemplate 236 includes data fields for the following additional parameters and/or control limits: a maximum offset wraps setpoint 242. The maximum offset wraps setpoint 242 sets the maximum amount of toolface correction that can be done in either direction when the selector 234 is enabled. The subtemplate 238 is substantially identical to the subtemplate 204, and therefore will not be described in further detail. The subtemplate 240 includes data fields for the following parameters and/or control limits: a maximum toolface correction count setpoint 244, a toolface count setpoint 246, and an oscillation count setpoint 248. The maximum toolface correction count setpoint 244 sets the maximum number of toolface-based corrections the rig control system 102 is permitted to make before transitioning to oscillation-based toolface orientation corrections. The toolface count setpoint 246 sets the number of toolface orientation reading that must be received from the sensor engine 108 before the rig control system 102 decides to increase or decrease the amount of oscillation. The oscillation count setpoint 248 sets a limit to how may oscillation adjustments the rig control system 102 is permitted to make before the driller is alerted.

In combination, the sequence template(s) described above at least partially facilitate the completion of tasks in the process of slide drilling a stand down. Specifically, the sequence template(s) provide a framework for completing the process but require the input of specific recipes into the above-described data fields before the process can be successfully carried out. The selection of appropriate recipes for entry into the various data fields of the sequence template(s) may be determined (at least in part) by rig personnel or others involved in the drilling operation. In addition, or instead, the recipe optimization module 116 may generate or change these recipes in order to improve the process of slide drilling a stand down—such improvement is produced by automatically inputting or otherwise communicating (e.g., using the rig control system 102) recipe data into one or more data fields of the sequence template(s) described above.

The recipe optimization module 116 is configured to monitor key performance indicators ("KPIs") including, for example, pre-slide time, toolface setting time, burned time, burned footage, slide score, and slide rate of penetration ("ROP"). These KPIs can be used to define success criteria for each task in the process of slide drilling a stand down. The pre-slide time can be defined as the amount of time it takes to initiate slide drilling for a particular stand—one or more of the following tasks may be achieved during the pre-slide time: removing trapped torque from the drill string 32, oscillating the drill string 32 before the initiation of slide drilling, and obtaining the target toolface orientation. The toolface setting time can be defined as the amount of time it takes to obtain the target toolface orientation for a particular stand. The burned time can be defined as the amount of time it takes after the initiation of slide drilling for a particular stand to receive a set number of consecutive toolface orientation readings (e.g., two consecutive readings) from the sensor engine 108 within a set range (e.g., 45 degrees) of the target toolface orientation. The burned footage can be defined as the length of the wellbore segment drilled during the burned time. The slide ROP can be obtained, for example, by averaging the on-bottom slide ROP over a period including off-bottom time during the slide.

Figure 11:
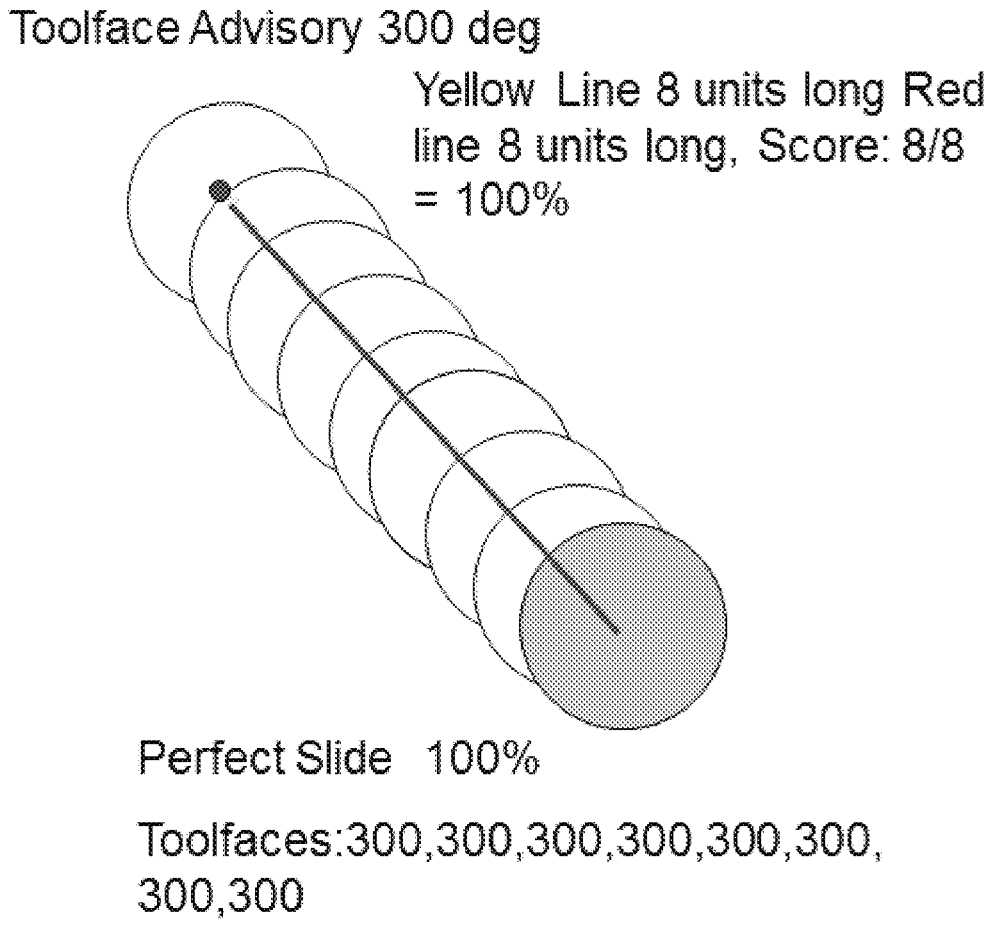
FIG. 11 diagrammatically illustrates a wellbore path drilled with a constant toolface orientation, according to one or more embodiments of the present disclosure.
Figure 12:
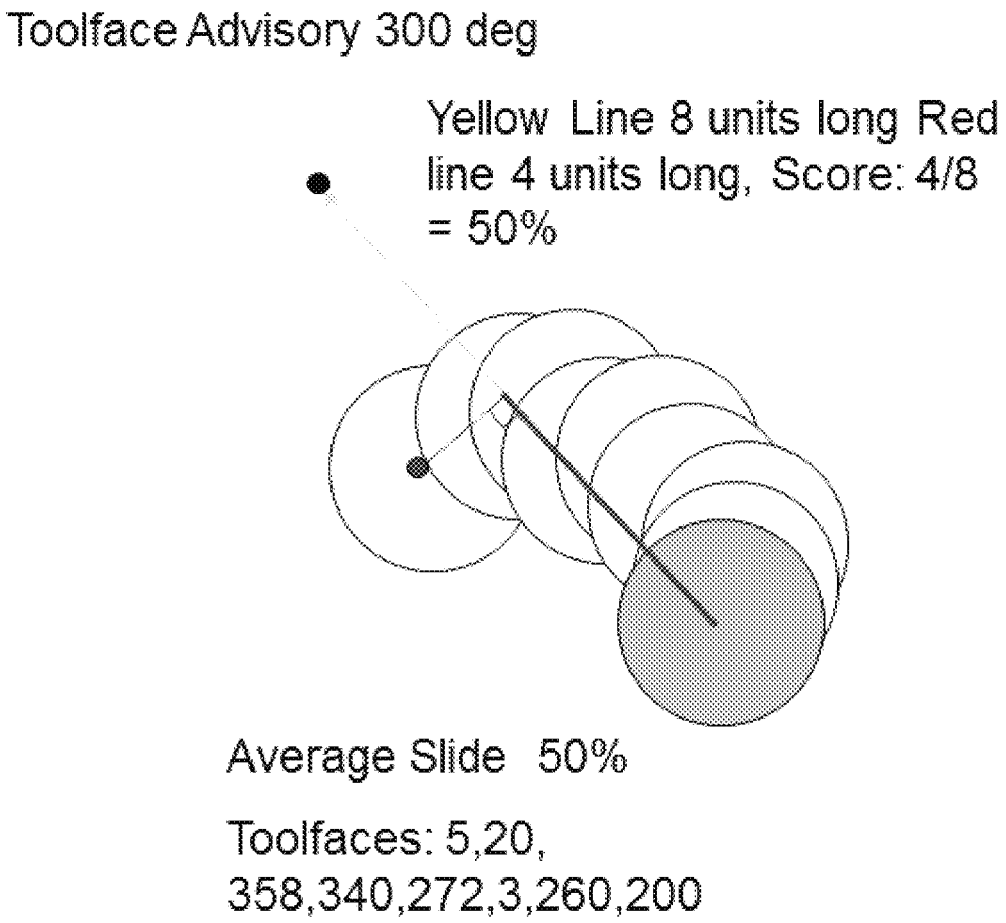
FIG. 12 diagrammatically illustrates a wellbore path drilled with a changing toolface orientation, according to one or more embodiments of the present disclosure.

Finally, the slide score can be obtained by receiving a set number of consecutive toolface orientation readings from the sensor engine 108 and comparing those readings with the target toolface orientation during the same period. For example, if the target toolface orientation was constant at 300 degrees during the period in question, the planned path of the wellbore 34 would curve up and to the left along a single plane, as viewed in FIG. 11. However, if the consecutive toolface orientation readings received from the sensor engine 108 during the same period included readings of 5 degrees, 20 degrees, 358 degrees, 340 degrees, 272 degrees, 3 degrees, 260 degrees, and 200 degrees, the actual path of the wellbore 34 would curve generally up and to the left along several different planes, as viewed in FIG. 12. This results in a difference between the planned and actual paths of the wellbore 34, which difference can be assigned a slide score from −100% to +100% depending on how close the actual path comes to the planned path.

Figure 13:
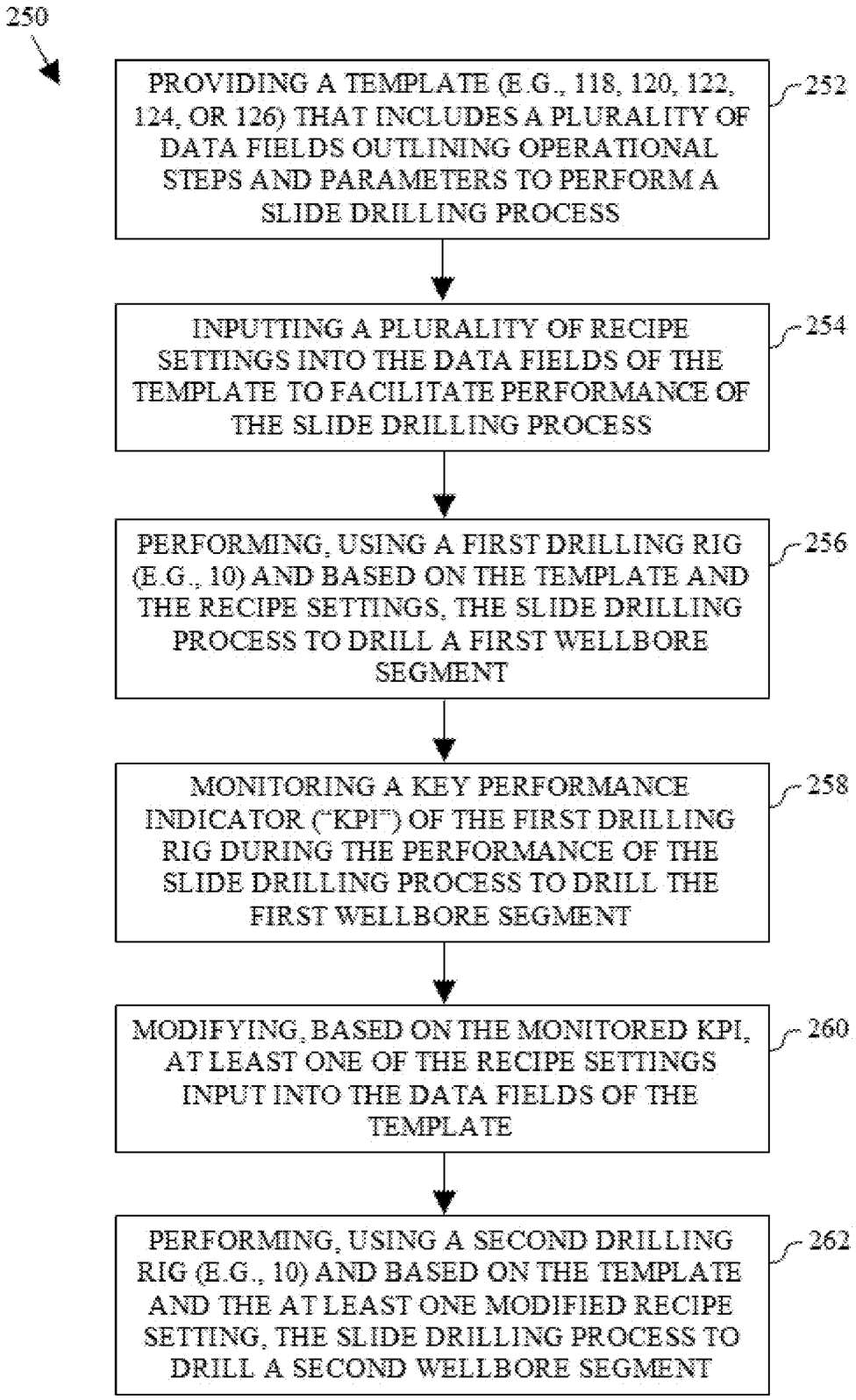
FIG. 13 a flow diagram of a method for implementing one or more embodiments of the present disclosure.

Referring to FIG. 13, a method is diagrammatically illustrated and generally referred to by the reference numeral 250—in some embodiments, the method 250 is executable by the rig control system 102 to generate or change drilling recipes based at least partially on the KPIs discussed above (or other KPIs). Thus, the method 250 is executable to improve the process of slide drilling a stand down by automatically inputting or otherwise communicating (e.g., using the rig control system 102) recipe data into one or more data fields of the sequence template(s) described above.

The method 250 may include providing a template (e.g., 118, 120, 122, 124, or 126) that includes a plurality of data fields outlining operational steps and parameters to perform a slide drilling process at a step 252, inputting a plurality of recipe settings into the data fields of the template to facilitate performance of the slide drilling process at a step 254, and performing, using a first drilling rig (e.g., 10) and based on the template and the recipe settings, the slide drilling process to drill a first wellbore segment at a step 256. In some embodiments, the step 256 of performing, using the first drilling rig and based on the template and the recipe settings, the slide drilling process to drill the first wellbore segment includes sending control signals to an operational equipment engine (e.g., 110) of the first drilling rig.

The method may also include monitoring a key performance indicator ("KPI") of the first drilling rig during the performance of the slide drilling process to drill the first wellbore segment at a step 258. In some embodiments, the step 258 of monitoring the KPI of the first drilling rig during the performance of the slide drilling process to drill the first wellbore segment includes monitoring operational parameters sensed by a sensor engine (e.g., 108). The monitored KPI may include a pre-slide time, a toolface setting time, a burned time, a burned footage, a slide score, a slide rate of penetration ("ROP"), or any combination thereof. The method may also include modifying, based on the monitored KPI, at least one of the recipe settings input into the data fields of the template at a step 260. In some embodiments, the step 260 includes automatically inputting the at least one modified recipe setting into the corresponding data field of the template.

Finally, the method may include performing, using a second drilling rig (e.g., 10) and based on the template and the at least one modified recipe setting, the slide drilling process to drill a second wellbore segment at a step 262. The first and second wellbore segments may be part of different wellbores and the first and second drilling rigs may be different drilling rigs. Alternatively, the first and second wellbore segments may be part of the same wellbore and the first and second drilling rigs may be the same drilling rig. In some embodiments, the step 262 of performing, using the second drilling rig and based on the template and the at least one modified recipe setting, the slide drilling process to drill the second wellbore segment includes sending control signals to an operational equipment engine (e.g., 110) of the second drilling rig.

Figure 14:
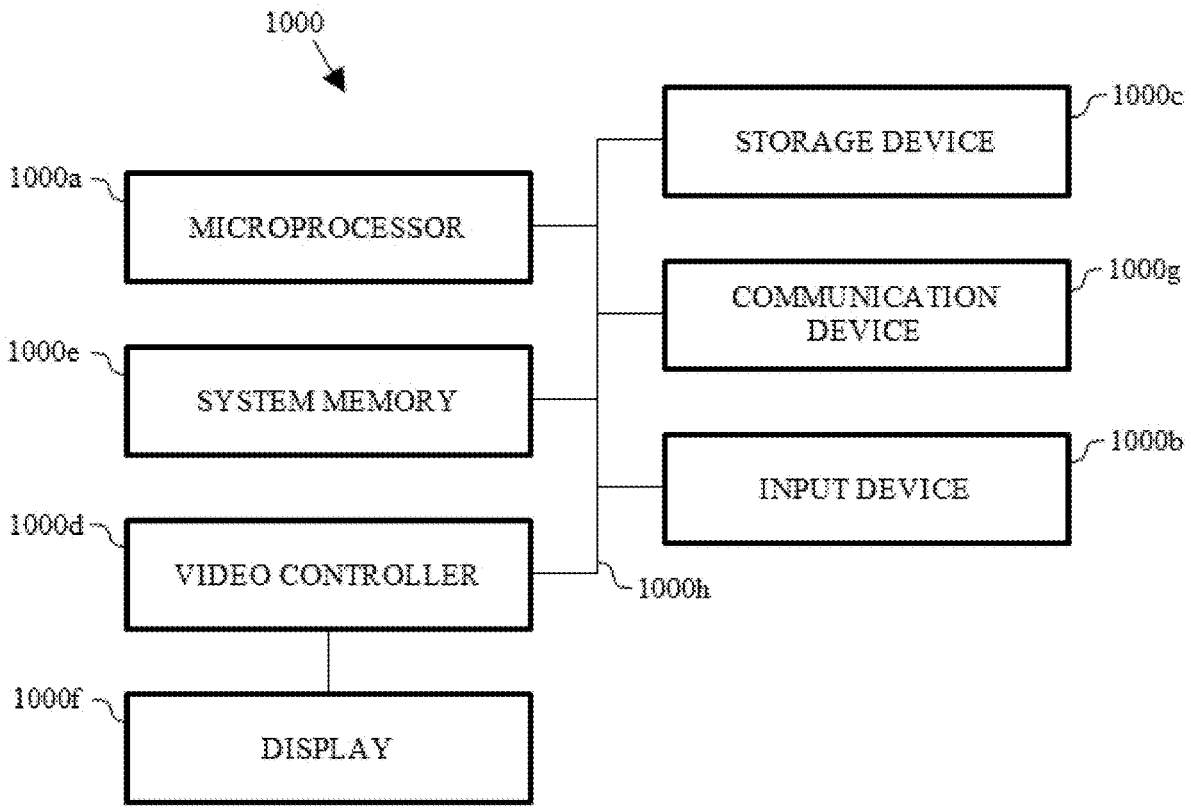
FIG. 14 is a diagrammatic illustration of a computing device for implementing one or more embodiments of the present disclosure.

Referring to FIG. 14, an embodiment of a computing device 1000 for implementing one or more embodiments of one or more of the above-described controllers (e.g., 58, 96, 98, or 100), control systems (e.g., 50 or 102), computer systems (e.g., 98), methods (e.g., 250), and/or steps (e.g., 152, 154, 156, 158, 160, or 162), and/or any combination thereof, is depicted. The computing device 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In some embodiments, the storage device 1000*c* may include a floppy drive, hard drive, CD-ROM, optical drive, any other form of storage device and/or any combination thereof. In some embodiments, the storage device 1000*c* may include, and/or be capable of receiving, a floppy disk, CD-ROM, DVD-ROM, or any other form of computer-readable medium that may contain executable instructions. In some embodiments, the communication device 1000*g* may include a modem, network card, or any other device to enable the computing device to communicate with other computing devices. In some embodiments, any computing device represents a plurality of interconnected (whether by intranet or Internet) computer systems, including without limitation, personal computers, mainframes, PDAs, smartphones and cell phones.

The computing device can send a network message using proprietary protocol instructions to render 3D models and/or medical data. The link between the computing device and the display unit and the synchronization between the programmed state of physical manikin and the rendering data/3D model on the display unit of the present invention facilitate enhanced learning experiences for users. In this regard, multiple display units can be used simultaneously by multiple users to show the same 3D models/data from different points of view of the same manikin(s) to facilitate uniform teaching and learning, including team training aspects.

In some embodiments, one or more of the components of the above-described embodiments include at least the computing device 1000 and/or components thereof, and/or one or more computing devices that are substantially similar to the computing device 1000 and/or components thereof. In some embodiments, one or more of the above-described components of the computing device 1000 include respective pluralities of same components.

In some embodiments, a computer system typically includes at least hardware capable of executing machine readable instructions, as well as the software for executing acts (typically machine-readable instructions) that produce a desired result. In some embodiments, a computer system may include hybrids of hardware and software, as well as computer sub-systems.

In some embodiments, hardware generally includes at least processor-capable platforms, such as client-machines (also known as personal computers or servers), and handheld processing devices (such as smart phones, tablet computers, personal digital assistants (PDAs), or personal computing devices (PCDs), for example). In some embodiments, hardware may include any physical device that is capable of storing machine-readable instructions, such as memory or other data storage devices. In some embodiments, other forms of hardware include hardware sub-systems, including transfer devices such as modems, modem cards, ports, and port cards, for example.

In some embodiments, software includes any machine code stored in any memory medium, such as RAM or ROM, and machine code stored on other devices (such as floppy disks, flash memory, or a CD ROM, for example). In some embodiments, software may include source or object code. In some embodiments, software encompasses any set of instructions capable of being executed on a computing device such as, for example, on a client machine or server.

In some embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In some embodiments, computer readable mediums include, for example, passive data storage, such as a random access memory (RAM) as well as semi-permanent data storage such as a compact disk read only memory (CD-ROM). One or more embodiments of the present disclosure may be embodied in the RAM of a computer to transform a standard computer into a new specific computing machine. In some embodiments, data structures are defined organizations of data that may enable an embodiment of the present disclosure. In an embodiment, a data structure may provide an organization of data, or an organization of executable code.

In some embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In some embodiments, a database may be any standard or proprietary database software. In some embodiments, the database may have fields, records, data, and other database elements that may be associated through database specific software. In some embodiments, data may be mapped. In some embodiments, mapping is the process of associating one data entry with another data entry. In an embodiment, the data contained in the location of a character file can be mapped to a field in a second table. In some embodiments, the physical location of the database is not limiting, and the database may be distributed. In an embodiment, the database may exist remotely from the server, and run on a separate platform. In an embodiment, the database may be accessible across the Internet. In some embodiments, more than one database may be implemented.

In some embodiments, a plurality of instructions stored on a non-transitory computer readable medium may be executed by one or more processors to cause the one or more processors to carry out or implement in whole or in part the above-described operation of each of the above-described embodiments of the drilling rig 10, the apparatus 54, the computer system 104, the interface engine 106, the sensor engine 108, the operational equipment engine 110, the slide drilling sequence engine 112, the sequence template module 114, and/or the recipe optimization module 116, and/or any combination thereof. In some embodiments, such a processor may include the microprocessor 1000*a*, and such a non-transitory computer readable medium may include the storage device 1000*c*, the system memory 1000*e*, or a combination thereof. Moreover, the computer readable medium may be distributed among one or more components of the drilling rig 10, the apparatus 54, the computer system 104, the interface engine 106, the sensor engine 108, the operational equipment engine 110, the slide drilling sequence engine 112, the sequence template module 114, and/or the recipe optimization module 116, and/or any combination thereof. In some embodiments, such a processor may execute the plurality of instructions in connection with a virtual computer system. In some embodiments, such a plurality of instructions may communicate directly with the one or more processors, and/or may interact with one or more operating systems, middleware, firmware, other applications, and/or any combination thereof, to cause the one or more processors to execute the instructions.

The present disclosure introduces a method, including providing, using a computing device, a template that includes a plurality of data fields outlining operational steps and parameters to perform a slide drilling process; inputting, using the computing device, a plurality of recipe settings into the data fields of the template to facilitate performance of the slide drilling process; performing, using a first drilling rig and based on the template and the recipe settings, the slide drilling process to drill a first wellbore segment; monitoring a key performance indicator ("KPI") of the first drilling rig during the performance of the slide drilling process to drill the first wellbore segment; modifying, using the computing device and based on the monitored KPI, at least one of the recipe settings input into the data fields of the template; and performing, using a second drilling rig and based on the template and the at least one modified recipe setting, the slide drilling process to drill a second wellbore segment. In some embodiments, monitoring the KPI of the first drilling rig during the performance of the slide drilling process to drill the first wellbore segment includes monitoring, using the computing device, operational parameters sensed by a sensor engine of the first drilling rig. In some embodiments, the monitored KPI includes a pre-slide time, a toolface setting time, a burned time, a burned footage, a slide score, a slide rate of penetration ("ROP"), or any combination thereof. In some embodiments, either: the first and second wellbore segments are part of different wellbores and the first and second drilling rigs are different drilling rigs; or the first and second wellbore segments are part of the same wellbore and the first and second drilling rigs are the same drilling rig. In some embodiments, performing, using the first drilling rig and based on the template and the recipe settings, the slide drilling process to drill the first wellbore segment includes sending, using the computing device, control signals to an operational equipment engine of the first drilling rig. In some embodiments, performing, using the second drilling rig and based on the template and the at least one modified recipe setting, the slide drilling process to drill the second wellbore segment includes sending, using the computing device, control signals to an operational equipment engine of the second drilling rig. In some embodiments, the method further includes automatically inputting, using the computing device, the at least one modified recipe setting into the corresponding data field of the template.

The present disclosure also introduces an apparatus, including: a non-transitory computer readable medium; and a plurality of instructions stored on the non-transitory computer readable medium and executable by one or more processors, the plurality of instructions including: instructions that, when executed, cause the one or more processors to provide a template that includes a plurality of data fields outlining operational steps and parameters to perform a slide drilling process; instructions that, when executed, cause the one or more processors to input a plurality of recipe settings into the data fields of the template to facilitate performance of the slide drilling process; instructions that, when executed, cause the one or more processors to generate a first control signal that controls, based on the template and the recipe settings, a first drilling rig's performance of the slide drilling process to drill a first wellbore segment; instructions that, when executed, cause the one or more processors to monitor a key performance indicator ("KPI") of the first drilling rig during the performance of the slide drilling process to drill the first wellbore segment; instructions that, when executed, cause the one or more processors to modify, based on the monitored KPI, at least one of the recipe settings input into the data fields of the template; and instructions that, when executed, cause the one or more processors to generate a second control signal that controls, based on the template and the at least one modified recipe setting, a second drilling rig's performance of the slide drilling process to drill a second wellbore segment. In some embodiments, the instructions that, when executed, cause the one or more processors to monitor the KPI of the first drilling rig during the performance of the slide drilling process to drill the first wellbore segment include instructions that, when executed, cause the one or more processors to monitor operational parameters sensed by a sensor engine of the first drilling rig. In some embodiments, the monitored KPI includes a pre-slide time, a toolface setting time, a burned time, a burned footage, a slide score, a slide rate of penetration ("ROP"), or any combination thereof. In some embodiments, either: the first and second wellbore segments are part of different wellbores and the first and second drilling rigs are different drilling rigs; or the first and second wellbore segments are part of the same wellbore and the first and second drilling rigs are the same drilling rig. In some embodiments, the apparatus further includes an operational equipment engine of the first drilling rig configured to perform the slide drilling process based on the generated first control signal. In some embodiments, the apparatus further includes an operational equipment engine of the second drilling rig configured to perform the slide drilling process based on the generated second control signal. In some embodiments, the plurality of instructions further include instructions that, when executed, cause the one or more processors to automatically input, using the computing device, the at least one modified recipe setting into the corresponding data field of the template.

The present disclosure also introduces a rig control system, including a slide drilling sequence engine including a sequence template module configured to provide a template that includes a plurality of data fields outlining operational steps and parameters to perform a slide drilling process, the data fields having a plurality of recipe settings input therein to facilitate performance of the slide drilling process; an operational equipment engine configured to perform the slide drilling process; a computer system in communication with the slide drilling sequence engine and the operational equipment engine, the computer system being configured to send a first control signal, based on the template and the recipe settings, to the operational equipment engine to cause the operational equipment engine to perform the slide drilling process to drill a first wellbore segment; and a sensor engine configured to monitor a key performance indicator ("KPI") of the operational equipment engine during the performance of the slide drilling process to drill the first wellbore segment; wherein the slide drilling sequence engine further includes a recipe optimization module configured to modify, based on the monitored KPI, at least one of the recipe settings input into the data fields of the template. In some embodiments, the computer engine is further configured to send a second control signal, based on the template and the at least one modified recipe setting, to the operational equipment engine to cause the operational equipment engine to perform the slide drilling process to drill a second wellbore segment. In some embodiments, the monitored KPI includes a pre-slide time, a toolface setting time, a burned time, a burned footage, a slide score, a slide rate of penetration ("ROP"), or any combination thereof. In some embodiments, either: the first and second wellbore segments are part of different wellbores; or the first and second wellbore segments are part of the same wellbore. In some embodiments, the computer system is further configured to automatically input the at least one modified recipe setting into the corresponding data field of the template. In some embodiments, the sequence template module includes a sequence template a start-up trapped torque sequence template, a tag bottom sequence template, an oscillation sequence template, an obtain target toolface sequence template, a maintain target toolface sequence template, or any combination thereof.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method for slide drilling, which comprises:

monitoring key performance indicators ("KPIs") of a first drilling rig while the first drilling rig performs a slide drilling process on a drill string to drill a first wellbore segment, wherein the performance of the slide drilling process by the first drilling rig to drill the first wellbore segment is caused by first control signals sent to an operational equipment engine of the first drilling rig, wherein the first control signals are based on a plurality of recipe settings input into data fields on a computing device, wherein the data fields outline operational steps and/or parameters of the slide drilling process, wherein the monitored KPIs comprise a slide score comparing an actual path of the first wellbore segment to a planned path of the first wellbore segment, and wherein the monitored KPIs further comprise a pre-slide time, a toolface setting time, a burned time, a burned footage, or any combination thereof;

modifying, based on the monitored KPIs, including the slide score, at least one of the recipe settings input into the data fields; and performing, based on the recipe settings, including the at least one modified recipe setting, the slide drilling process to drill a second wellbore segment.

2. The method of claim 1, wherein the slide score is determined by:

receiving a set number of consecutive toolface readings detected by a sensor engine of the first drilling rig during a period; and after receiving the set number of consecutive toolface readings, comparing the received toolface readings with a target toolface orientation during the period.

3. The method of claim 1, wherein:

the first and second wellbore segments are part of different wellbores.

4. The method of claim 1, wherein the performance of the slide drilling process to drill the second wellbore segment is caused by second control signals sent to an operational equipment engine of a second drilling rig; and wherein the second control signals are based on the recipe settings, including the at least one modified recipe setting, input into the data fields.

5. The method of claim 1, wherein modifying the at least one of the recipe settings comprises automatically inputting the at least one modified recipe setting into the corresponding data field on the computing device.

6. The method of claim 1, wherein the monitored KPIs comprise the pre-slide time, which pre-slide time is defined as the amount of time it takes to make off-bottom adjustments to the drill string before the slide drilling process is initiated; and wherein the off-bottom adjustments include removing trapped torque from the drill string, oscillating the drill string, obtaining a target toolface orientation, or any combination thereof.

7. An apparatus, comprising:

a non-transitory computer readable medium; and a plurality of instructions stored on the non-transitory computer readable medium and executable by one or more processors, wherein, when the instructions are executed by the one or more processors, the following steps are executed:

monitoring key performance indicators ("KPIs") of a first drilling rig while the first drilling rig performs a slide drilling process on a drill string to drill a first wellbore segment, wherein the performance of the slide drilling process by the first drilling rig to drill the first wellbore segment is caused by first control signals sent to an operational equipment engine of the first drilling rig, wherein the first control signals are based on a plurality of recipe settings input into data fields on a computing device, wherein the data fields outline operational steps and/or parameters of the slide drilling process, wherein the monitored KPI s comprises a slide score comparing an actual path of the first wellbore segment to a planned path of the first wellbore segment, and wherein the monitored KPIs further comprise a pre-slide time, a toolface setting time, a burned time, a burned footage, or any combination thereof;

modifying, based on the monitored KPIs, including the slide score, at least one of the recipe settings input into the data fields; and performing, based on the recipe settings, including the at least one modified recipe setting, the slide drilling process to drill a second wellbore segment.

8. The apparatus of claim 7, wherein the slide score is determined by:

receiving a set number of consecutive toolface readings detected by a sensor engine of the first drilling rig during a period; and after receiving the set number of consecutive toolface readings, comparing the received toolface readings with a target toolface orientation during the period.

9. The apparatus of claim 7, wherein:

the first and second wellbore segments are part of different wellbores.

10. The apparatus of claim 7, further comprising the operational equipment engine of the first drilling rig.

11. The apparatus of claim 7, further comprising an operational equipment engine of a second drilling rig;

wherein the performance of the slide drilling process to drill the second wellbore segment is caused by second control signals sent to the operational equipment engine of the second drilling rig; and wherein the second control signals are based on the recipe settings, including the at least one modified recipe setting, input into the data fields.

12. The apparatus of claim 7, wherein modifying the at least one of the recipe settings comprises automatically inputting the at least one modified recipe setting into the corresponding data field on the computing device.

13. The apparatus of claim 7, wherein the monitored KPIs comprise the pre-slide time, which pre-slide time is defined as the amount of time it takes to make off-bottom adjustments to the drill string before the slide drilling process is initiated; and wherein the off-bottom adjustments include removing trapped torque from the drill string, oscillating the drill string, obtaining a target toolface orientation, or any combination thereof.

14. A system, comprising:

a first drilling rig including an operational equipment engine;

a control system operably associated with the first drilling rig, wherein the control system:

sends first control signals to the operational equipment of the first drilling rig to cause the first drilling rig to perform a slide drilling process on a drill string to drill a first wellbore segment, wherein the first control signals are based on a plurality of recipe settings input into data fields on a computing device, and wherein the data fields outline operational steps and/or parameters of the slide drilling process;

monitors key performance indicators ("KPIs") of the first drilling rig while the first drilling rig performs the first slide drilling process on the drill string to drill the first wellbore segment, wherein the monitored KPIs comprise a slide score comparing an actual path of the first wellbore segment to a planned path of the first wellbore segment, and wherein the monitored KPIs further comprise a pre-slide time, a toolface setting time, a burned time, a burned footage, or any combination thereof;

modifies, based on the monitored KPI s, including the slide score, at least one of the recipe settings input into the data fields;

and generates second control signals, based on the recipe settings, including the at least one modified recipe setting, which second control signals are configured to cause performance of the slide drilling process to drill a second wellbore segment.

15. The system of claim 14, wherein the first drilling rig further comprises a sensor engine in communication with the control system; and wherein, to determine the slide score, the control system:

receives a set number of consecutive toolface readings detected by the sensor engine of the first drilling rig during a period; and after receiving the set number of consecutive toolface readings, compares the received toolface readings with a target toolface orientation during the period.

16. The system of claim 14, wherein:

the first and second wellbore segments are part of different wellbores.

17. The system of claim 14, wherein, to modify the at least one of the recipe settings, the computer system automatically inputs the at least one modified recipe setting into the corresponding data field on the computing device.

18. The system of claim 14, further comprising a second drilling rig including an operational equipment engine;

wherein the control system sends the second control signals to the operational equipment engine of the second drilling rig to cause the second drilling rig to drill the second wellbore segment; and wherein the second control signals are based on the recipe settings, including the at least one modified recipe setting, input into the data fields.

19. The system of claim 14, wherein the monitored KPIs comprise the pre-slide time, which pre-slide time is defined as the amount of time it takes to make off-bottom adjustments to the drill string before the slide drilling process is initiated; and wherein the off-bottom adjustments include removing trapped torque from the drill string, oscillating the drill string, obtaining a target toolface orientation, or any combination thereof.

* * * * *